US010912435B2

(12) United States Patent
Kelsey

(10) Patent No.: US 10,912,435 B2
(45) Date of Patent: Feb. 9, 2021

(54) HAIR CUTTING BRUSHROLL

(71) Applicant: SharkNinja Operating, LLC, Needham, MA (US)

(72) Inventor: Alden Kelsey, Newton Upper Falls, MA (US)

(73) Assignee: SharkNinja Operating LLC, Needham, MA (US)

( * ) Notice: Subject to any disclaimer, the term of this patent is extended or adjusted under 35 U.S.C. 154(b) by 157 days.

(21) Appl. No.: 15/989,964

(22) Filed: May 25, 2018

(65) Prior Publication Data

US 2018/0338654 A1 Nov. 29, 2018

Related U.S. Application Data

(60) Provisional application No. 62/543,281, filed on Aug. 9, 2017, provisional application No. 62/511,793, filed on May 26, 2017.

(51) Int. Cl.
*A47L 9/04* (2006.01)
*A46B 1/00* (2006.01)
(Continued)

(52) U.S. Cl.
CPC ..... *A47L 9/0477* (2013.01); *A46B 1/00* (2013.01); *A46B 13/001* (2013.01); *A46B 13/02* (2013.01);
(Continued)

(58) Field of Classification Search
CPC .... A47L 9/0477; A47L 7/0066; A47L 9/0488; A47L 9/04; A46B 1/00; A46B 13/02; A46B 13/001; A46B 2200/3033
See application file for complete search history.

(56) References Cited

U.S. PATENT DOCUMENTS 2,587,038 A 2/1952 Goodell
2,960,714 A 11/1960 Senne
(Continued)

FOREIGN PATENT DOCUMENTS

CN 105982615 A 10/2016
CN 205671990 U 11/2016
(Continued)

OTHER PUBLICATIONS

Chinese Office Action with English translation dated May 22, 2020, received in Chinese Patent Application No. 201880043227.0 8 pgs.
(Continued)

*Primary Examiner* — David Redding
(74) *Attorney, Agent, or Firm* — Grossman Tucker Perreault & Pfleger, PLLC

(57) ABSTRACT

A surface cleaning apparatus comprising a cleaning head and a brushroll. The cleaning head includes a cleaning head body having an agitator chamber including an opening on an underside of the cleaning head body. The brushroll is rotatably mounted to the cleaning head body such that a portion of the brushroll extends below the underside for directing debris into the opening. The brushroll includes an elongated body extending laterally between a first and second end region, a slit opening extending between the first and second end region, angular stationary teeth extending proximate to an edge of the slit opening, and a cutting blade configured to be at least partially received within the slit opening and to move laterally between the first and second end regions. The cutting blade bar includes teeth that are configured to engage with the stationary teeth to cut hair.

20 Claims, 26 Drawing Sheets

(51) Int. Cl.
*A46B 13/00* (2006.01)
*A47L 7/00* (2006.01)
*A46B 13/02* (2006.01)

(52) U.S. Cl.
CPC ..... *A47L 7/0066* (2013.01); *A47L 9/0488* (2013.01); *A46B 2200/3033* (2013.01)

(56) References Cited

U.S. PATENT DOCUMENTS

| | | | |
|---|---|---|---|
| 3,612,052 | A | 10/1971 | Krummenacher |
| 3,737,937 | A | 6/1973 | Nordeen |
| 4,177,536 | A | 12/1979 | Powers |
| 4,955,107 | A | 9/1990 | Kawai |
| 5,495,634 | A | 3/1996 | Brundula et al. |
| 6,170,119 | B1 | 1/2001 | Conrad et al. |
| 6,539,575 | B1 | 4/2003 | Cohen |
| 6,892,420 | B1 | 5/2005 | Haan et al. |
| 7,979,952 | B2 | 7/2011 | Beskow et al. |
| 8,083,167 | B1 | 12/2011 | Namakian et al. |
| 8,087,117 | B2 | 1/2012 | Kapoor et al. |
| 8,418,303 | B2 | 4/2013 | Kapoor et al. |
| 8,505,158 | B2 | 8/2013 | Han et al. |
| 8,572,799 | B2 | 11/2013 | Won et al. |
| 8,601,643 | B2 | 12/2013 | Eriksson |
| 8,671,515 | B2 | 3/2014 | Eriksson |
| 9,072,416 | B2 | 7/2015 | Kowalski |
| 9,192,273 | B2 | 11/2015 | Eriksson |
| 9,295,362 | B2 | 3/2016 | Eriksson |
| 9,295,364 | B2 | 3/2016 | Eriksson |
| 9,314,140 | B2 | 4/2016 | Eriksson |
| 9,320,398 | B2 | 4/2016 | Hussey et al. |
| 9,375,122 | B2 | 6/2016 | Eriksson |
| 9,480,374 | B2 | 11/2016 | Li et al. |
| 9,492,048 | B2 | 11/2016 | Won et al. |
| 9,615,708 | B2 | 4/2017 | Kowalski |
| 9,775,477 | B2 | 10/2017 | Eriksson |
| 9,820,624 | B2 | 11/2017 | Eriksson |
| 9,820,626 | B2 | 11/2017 | Eriksson et al. |
| 9,833,115 | B2 | 12/2017 | Eriksson |
| 9,839,335 | B2 | 12/2017 | Eriksson |
| 9,999,330 | B2 * | 6/2018 | Fang ..... A47L 9/0477 |
| 2006/0042042 | A1 | 3/2006 | Mertes et al. |
| 2007/0209147 | A1 | 9/2007 | Krebs et al. |
| 2008/0115736 | A1 | 5/2008 | Porter et al. |
| 2010/0011529 | A1 | 1/2010 | Won et al. |
| 2013/0007982 | A1 | 1/2013 | Yun |
| 2014/0053351 | A1 | 2/2014 | Kapoor et al. |
| 2014/0259522 | A1 | 9/2014 | Kasper et al. |
| 2014/0366300 | A1 | 12/2014 | Eriksson |
| 2015/0230676 | A1 | 8/2015 | Eriksson |
| 2015/0313431 | A1 | 11/2015 | Eriksson |
| 2015/0342430 | A1 | 12/2015 | Kasper et al. |
| 2016/0058257 | A1 | 3/2016 | Ventress et al. |
| 2016/0166052 | A1 | 6/2016 | Kasper et al. |
| 2016/0220082 | A1 | 8/2016 | Thorne et al. |
| 2016/0220084 | A1 | 8/2016 | Xu et al. |
| 2017/0172363 | A1 | 6/2017 | Eriksson et al. |
| 2017/0172364 | A1 | 6/2017 | Eriksson |
| 2017/0311767 | A1 | 11/2017 | Fang |
| 2018/0070785 | A1 | 3/2018 | Udy et al. |

FOREIGN PATENT DOCUMENTS

| | | | |
|---|---|---|---|
| CN | 107233047 | A | 10/2017 |
| GB | 583738 | | 12/1946 |
| GB | 2310213 | A | 8/1997 |
| WO | 2014140872 | A2 | 9/2014 |

OTHER PUBLICATIONS

U.S. Office Action dated Apr. 29, 2020, received in U.S. Appl. No. 15/917,598, 12 pgs.
PCT Search Report and Written Opinion dated Aug. 24, 2018, received in corresponding PCT Application No. PCT/US18/34668, 7 pgs.
PCT Search Report and Written Opinion dated May 3, 2019, received in corresponding PCT Application No. PCT/US18/67163, 14 pgs.
U.S. Office Action dated May 1, 2019, received in U.S. Appl. No. 15/699,358, 26 pgs.
PCT International Search Report and Written Opinion dated Jun. 6, 2018, received in related PCT Application No. PCT/US18/21888, 12 pgs.
PCT Search Report and Written Opinion dated Dec. 20, 2017, received in related PCT Application No. PCT/US17/50691, 11 pgs.
PCT Search Report and Written Opinion dated Mar. 5, 2019, received in related PCT Application No. PCT/US18/67171, 8 pgs.

* cited by examiner

HAIR CUTTING BRUSHROLL

CROSS REFERENCE TO RELATED APPLICATIONS

The present application claims the benefit of U.S. Provisional Patent Application Ser. No. 62/511,793, filed May 26, 2017 and U.S. Provisional Patent Application Ser. No. 62/543,281, filed Aug. 9, 2017, both of which are fully incorporated herein by reference.

TECHNICAL FIELD

The present disclosure relates generally to a vacuum cleaner brushroll, and more particularly, to a brushroll that cuts hair.

BACKGROUND

A surface cleaning apparatus may be used to clean a variety of surface. Some surface cleaning apparatuses include a rotating agitator (e.g., brush roll). One example of a surface cleaning apparatus includes a vacuum cleaner which may include a rotating agitator as well as vacuum source. Non-limiting examples of vacuum cleaners include upright vacuum cleaners, canister vacuum cleaners, stick vacuum cleaners, central vacuum systems, and robotic vacuum systems. Another type of surface cleaning apparatus includes powered brooms which include a rotating agitator (e.g., brush roll) that collects debris, but does not include a vacuum source.

While the known surface cleaning apparatuses are generally effective at collecting debris, some debris (such as hair) may become entangled in the agitator. The entangled hair may reduce the efficiency of the agitator, and may cause damage to the motor and/or drive train that rotates the agitator. Moreover, it may be difficult to remove the hair from the agitator because the hair is entangled in the bristles.

There are known brush rollers that cut hair when rolled through hair. However, each of the known hair cutting brush rolls are heavy, expensive, and require extensive balancing. The known hair cutting brush rolls utilize a centrifugal cam and a pair of weighted internal jaws that swing outwards when spinning. Cam surfaces on the back of the metal jaws cycle a pair of sheer blade plates, which move on startup, shutdown, and during operation when the motor is pulsed. However, this design requires several machined parts that are very heavy, causing the parts to fall out of balance during operation.

BRIEF DESCRIPTION OF THE DRAWINGS

Embodiments are illustrated by way of example in the accompanying figures, in which like reference numbers indicate similar parts, and in which.

DETAILED DESCRIPTION

While the making and using of various embodiments of the present disclosure are discussed in detail below, it should be appreciated that the present disclosure provides many applicable inventive concepts that can be embodied in a wide variety of specific contexts. The specific embodiments discussed herein are merely illustrative of specific ways to make and use the disclosure and do not limit the scope of the disclosure.

Figure 1:
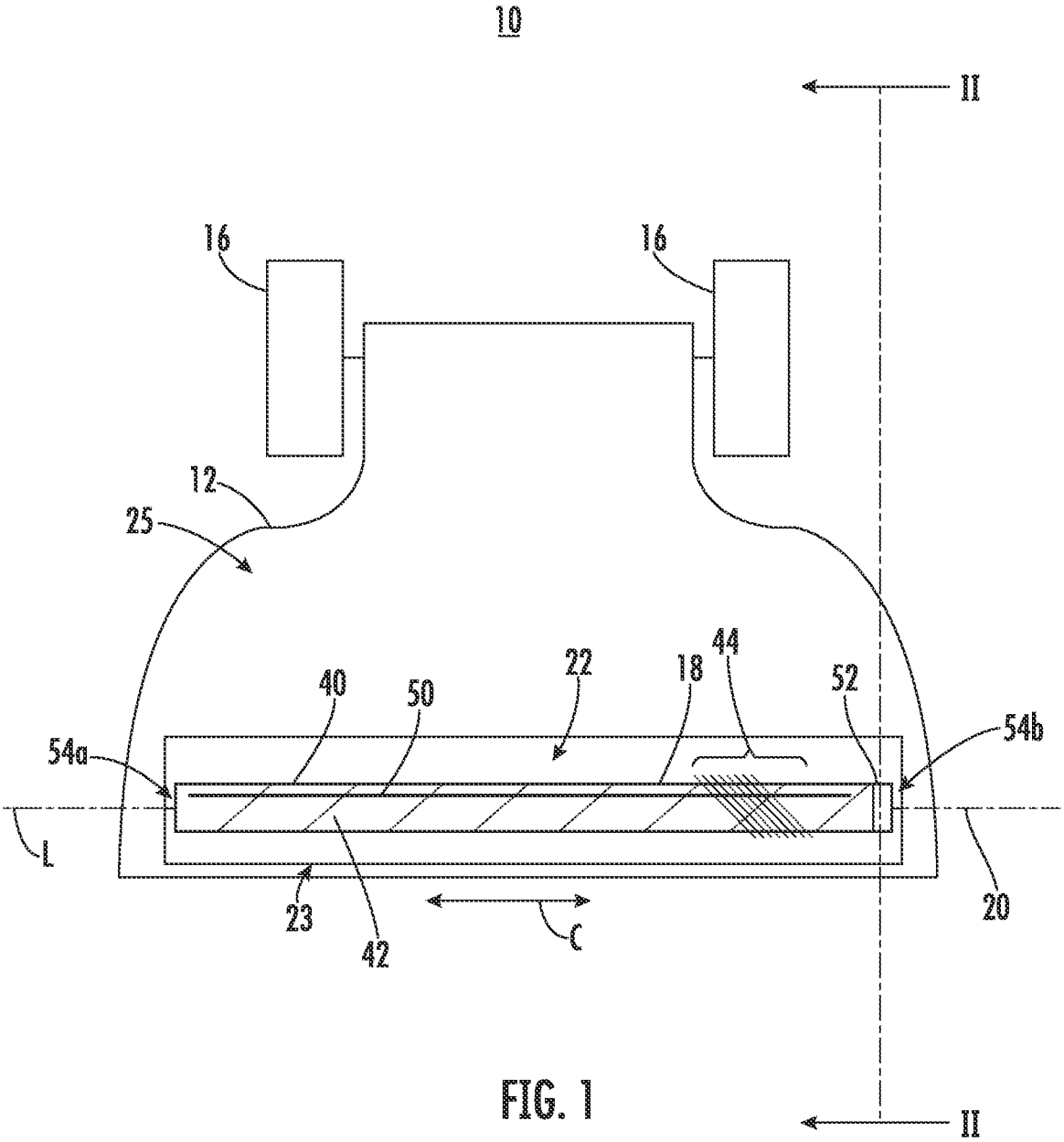
FIG. 1 is a bottom view of one embodiment of a surface cleaning apparatus, consistent with the present disclosure.
Figure 2:
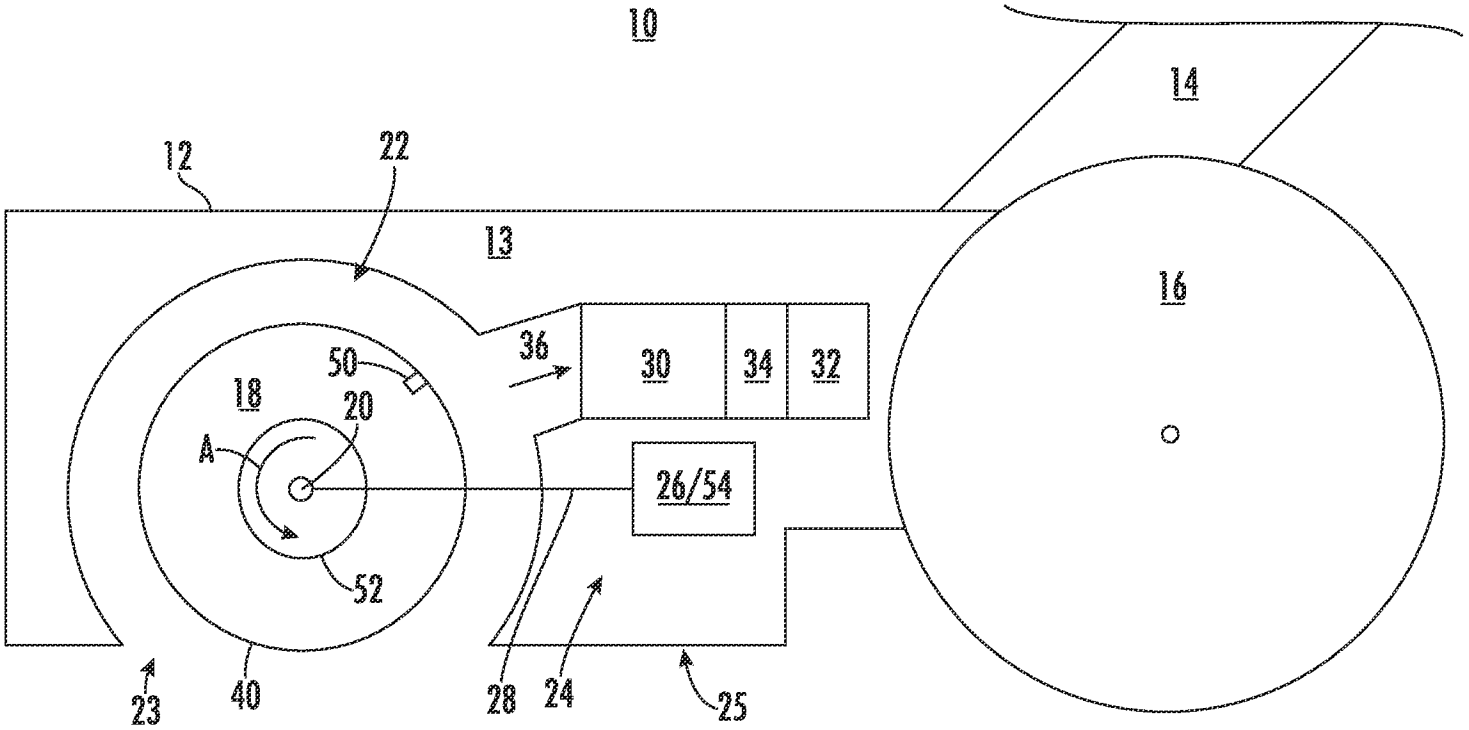
FIG. 2 is a cross-sectional view of the surface cleaning apparatus of FIG. 1 taken along line II-II.

Turning now to FIGS. 1 and 2, one embodiment of a surface cleaning apparatus 10 is generally illustrated. In particular, FIG. 1 generally illustrates a bottom view of a surface cleaning apparatus 10 and FIG. 2 generally illustrates a cross-section of the surface cleaning apparatus 10 taken along lines II-II of FIG. 1. The surface cleaning apparatus 10 includes a cleaning head 12 and optionally a handle 14. In the illustrated embodiment, the handle 14 is pivotally coupled to the cleaning head 12 such that the user may grasp the handle 14 while standing to move the cleaning head 12 on the surface to be cleaned using one or more wheels 16. It should be appreciated; however, that the cleaning head 12 and the handle 14 may be an integrated or unitary structure (e.g., such as a handleheld vacuum). Alternatively, the handle 14 may be eliminated (e.g., such as a robot-type vacuum).

The cleaning head 12 includes a cleaning head body or frame 13 that at least partially defines/includes one or more agitator chambers 22. The agitator chambers 22 include one or more openings 23 defined within and/or by a portion of the bottom surface/plate 25 of the cleaning head 12/cleaning head body 13. At least one rotating agitator or brushroll 18 is configured to be coupled to the cleaning head 12 (either permanently or removably coupled thereto) and is configured to be rotated about a pivot axis 20 (e.g., in the direction and/or reverse direction of arrow A, FIG. 2) within the agitator chambers 22 by one or more rotation systems 24. The rotation systems 24 may be at least partially disposed in the vacuum head 12 and/or handle 16, and may one or more motors 26 (either AC and/or DC motors) coupled to one or more belts and/or gear trains 28 for rotating the agitators 18.

The surface cleaning apparatus 10 includes a debris collection chamber 30 in fluid communication with the agitator chamber 22 such that debris collected by the rotating agitator 18 may be stored. Optionally, the agitator chamber 22 and debris chamber 30 are fluidly coupled to a vacuum source 32 (e.g., a vacuum pump or the like) for generating a partial vacuum in the agitator chamber 22 and debris collection chamber 30 and to suck up debris proximate to the agitator chamber 22 and/or agitator 18. As may be appreciated, the rotation of the agitator 18 may aid in agitating/loosening debris from the cleaning surface. Optionally, one or more filters 34 may be provided to remove any debris (e.g., dust particles or the like) entrained in the partial vacuum air flow. The debris chamber 30, vacuum source 32, and/or filters 34 may be at least partially located in the cleaning head 12 and/or handle 14. Additionally, one or more tubes, ducts, or the like 36 may be provided to fluidly couple the debris chamber 30, vacuum source 32, and/or filters 34. The surface cleaning apparatus 10 may include and/or may be configured to be electrically coupled to one or more power sources such as, but not limited to, an electrical cord/plug, batteries (e.g., rechargeable, and/or non-rechargeable batteries), and/or circuitry (e.g., AC/DC converters, voltage regulators, step-up/down transformers, or the like) to provide electrical power to various components of the surface cleaning apparatus 10 such as, but not limited to, the rotation systems 24 and/or the vacuum source 32.

The agitator 18 includes an elongated agitator body 40 that is configured to extend along and rotate about a longitudinal/pivot axis 20. The agitator 18 (e.g., but not limited to, one or more of the ends of the agitator 18) is permanently or removably coupled to the vacuum head 12 and may be rotated about the pivot axis 20 by the rotation system 24. In the illustrated embodiment, the elongated agitator body 40 has a generally cylindrical cross-section, though other cross-sectional shapes (such as, but not limited to, oval, hexagonal, rectangular, octagonal, concaved, convex, and the like) are also possible. The agitator 18 may have bristles, fabric, felt, nap, pile, and/or other cleaning elements (or any combination thereof) 42 around the outside of the elongated agitator body 40. Examples of brush rolls and other agitators 18 are shown and described in greater detail in U.S. Pat. No. 9,456,723 and U.S. Patent Application Pub. No. 2016/0220082, which are fully incorporated herein by reference.

The cleaning elements 42 may include rigid and/or stiff bristles designed for cleaning carpets or the like and/or relatively soft material (e.g., soft bristles, fabric, felt, nap or pile) arranged in a pattern (e.g., a spiral pattern) to facilitate capturing debris, as will be described in greater detail below. The relatively soft material for the cleaning elements 42 may include, without limitation, thin nylon bristles (e.g., a diameter of 0.04±0.02 mm) or a textile or fabric material, such as felt, or other material having a nap or pile suitable for cleaning a surface. Multiple different types of materials may be used together to provide different cleaning characteristics. A relatively soft material may be used, for example, with a more rigid material such as stiffer bristles (e.g., nylon bristles with a diameter of 0.23±0.02 mm). Materials other than nylon may also be used such as, for example, carbon fibers. The material may be arranged in a pattern around the agitator 18, such as the spiral pattern shown in FIG. 1, to facilitate movement of debris toward the openings 23 and into the suction conduit 36. The spiral pattern may be formed, for example, by a wider strip of the relatively soft material and a thinner strip of more rigid material. Other patterns may also be used and are within the scope of the present disclosure.

The softness, length, diameter, arrangement, and resiliency of the bristles and/or pile of the agitator 18 may be selected to form a seal with a hard surface (e.g., but not limited to, a hard wood floor, tile floor, laminate floor, or the like), whereas the rigid bristles of the agitator 18 may selected to agitate carpet fibers or the like. For example, the soft cleaning elements 42 may be at least 25% softer than the rigid cleaning elements 42, alternatively the soft cleaning elements 42 may be at least 30% softer than the rigid cleaning elements 42, alternatively the soft cleaning elements 42 may be at least 35% softer than the rigid cleaning elements 42, alternatively the soft cleaning elements 42 may be at least 40% softer than the rigid cleaning elements 42, alternatively the soft cleaning elements 42 may be at least 50% softer than the rigid cleaning elements 42, alternatively the soft cleaning elements 42 may be at least 60% softer than the rigid cleaning elements 42. Softness may be determined, for example, based on the pliability of the bristles or pile being used.

The size and shape of the bristles and/or pile may be selected based on the intended application. For example, the soft cleaning elements 42 may include bristles and/or pile having a length of between 5 to 15 mm (e.g., 7 to 12 mm) and may have a diameter of 0.01 to 0.04 mm (e.g., 0.01-0.03 mm). According to one embodiment, the bristles and/or pile may have a length of 9 mm and a diameter of 0.02 mm. The bristles and/or pile may have any shape. For example, the bristles and/or pile may be linear, arcuate, and/or may have a compound shape. According to one embodiment, the bristles and/or pile may have a generally U and/or Y shape. The U and/or Y shaped bristles and/or pile may increase the number of points contacting the floor surface, thereby enhancing sweeping function of agitator 18. The bristles and/or pile may be made on any material such as, but not limited to, Nylon 6 or Nylon 6/6.

Optionally, the bristles and/or pile of the rigid cleaning elements 42 may be heat treated, for example, using a post weave heat treatment. The heat treatment may increase the lifespan of the bristles and/or pile. For example, after weaving the fibers and cutting the velvet into rolls, the velvet may be rolled up and then run through a steam rich autoclave making the fibers/bristles more resilient fibers.

The surface cleaning apparatus 10, and specifically the agitator 18, may come into contact with elongated debris such as, but not limited to, hair, string, fibers, and the like (hereinafter collectively referred to as hair 44 for ease of explanation). The hair 44 may have a length that is much longer than the diameter of the agitator 18. By way of a non-limiting example, the hair 44 may have a length that is 2-10 times longer than the diameter of the agitator 18. Because of the rotation of the agitator 18 as well as the length and flexibility of the hair 44, the hair 44 will tend to wrap around the diameter of the agitator 18.

To address this, one embodiment of the present disclosure features an agitator/brushroll 18 having one or more cutting blades 50 configured to cut the hair 44 into smaller pieces which can be removed from the agitator 18 during normal rotation of the agitator 18, and ultimately picked up and stored by the surface cleaning apparatus 10 (e.g., entrapped in the dirty air suction of the surface cleaning apparatus 10). The agitator 18 may include a cutting blade actuator 52 coupled to a blade driver 54 for cycling the cutting blade 50. According one at least one embodiment, the cutting blade actuator 52 and the blade driver 54 may cycle the cutting blade 50 may axially (e.g., laterally) between the opposite ends 54*a*, 54*b* of the elongated body 40 of the agitator 18. For example, the cutting blade 50 may move generally in the direction of arrow C (FIG. 1) which is parallel to the pivot axis 20 and/or longitudinal axis L of the elongated body 40. Alternatively (or in addition to), the cutting blade 50 may cycle radially relative to the pivot axis 20 and/or longitudinal axis L.

By way of a general overview, the combination of the cutting blade actuator 52 and the cutting blade driver 54 creates or times the action (i.e., the movement of the cutting blade 50 relative to the elongated agitator body 40). For example, the cutting blade driver 54 may urge (e.g., impart a force to) the cutting blade actuator 52. The cutting blade actuator 52 may translate the force imparted by the cutting blade driver 54 into movement (e.g., cycling) of the cutting blade 50 relative to the elongated agitator body 40. The resulting movement of the cutting blade 50 may either synchronous, reduced, or intermittent action. Synchronous action refers to a 1:1 cycling of the cutting blade 50 to the rotation of the agitator 18. Non-limiting examples of synchronous action may use a cam or magnet to create 1:1 cycling of the cutting blade 50 while the brushroll 18 rotates relative to the driver. Reduced action refers to N:1 cycling of the cycling of the cutting blade 50 to the rotation of the agitator 18, where N is less than 1. As such, the cutting blade 50 cycles slower than the rotation of the agitator 18. Non-limiting examples of reduced action may use a gear train or auxiliary belt to create a slow relative motion between the cutting blade 50 and the actuator 18. That is, if the brushroll 18 rotates at 3000 rpm, the cutting blade actuator 52 and/or the cutting blade driver 54 may rotate at 2900 rpm causing 100 rpm of relative motion, and thus 100 rpm of blade cycling. Intermittent action refers non-continuous cycling of the cutting blade upon occurrence of some event. Non-limiting examples of intermittent action may use centrifugal cams, inertial drums, electromechanical solenoids, pneumatic cylinders, and/or user input through a mechanical linkage or direct force against the cutting blade 50. For example, centrifugal cams may be weighted elements that swing outwardly and cycle when the brushroll 18 crosses a critical speed, inertial drums may create relative rotation during critical acceleration, and electromechanical solenoids may push the cutting blade 50, while the pneumatic cylinder does the same.

As discussed above, the separate cutting blade actuator 52 converts motion of the cutting blade driver 54 to cycling of the cutting blade 50. Non-limiting examples of cutting blade actuators 52 include a barrel cam, alternating push/pull magnets, pneumatic cylinders wherein pressure is cycles as the brushroll rotates past ports, eccentric actuators wherein the brushroll rotates around an off-axis point such that the linkage can cause toothed bar cycling, and a swashplate wherein the brushroll rotates around a rotating element that is angularly offset from the brushroll axis, thereby cycling the toothed bar.

In addition, the cutting blade driver 54 may be configured to urge (e.g., impart a force to/against) the cutting blade actuator 52. Non-limiting examples of cutting blade drivers 54 may include one or more belts, gears (gear trains), motors, solenoids, centrifugal/inertial weights, etc.

Various configurations of agitators, cutting blades, cutting blade actuators, and blade drivers are described herein. While specific combinations of agitators, cutting blades, cutting blade actuators, and blade drivers may be shown, it should be appreciated that the present disclosure encompasses any combination of the agitators, cutting blades, cutting blade actuators, and blade drivers. As such, the present disclosure is not limited to the specific combinations of agitators, cutting blades, cutting blade actuators, and blade drivers shown in the figures unless specifically claimed as such. In addition, one or more machined parts of the agitators, cutting blades, cutting blade actuators, and/or blade drivers may be eliminated and replaced with molded plastic parts and the cutting blade actuator and/or blade driver may be redesigned to reduce complexity.

Figure 3A:
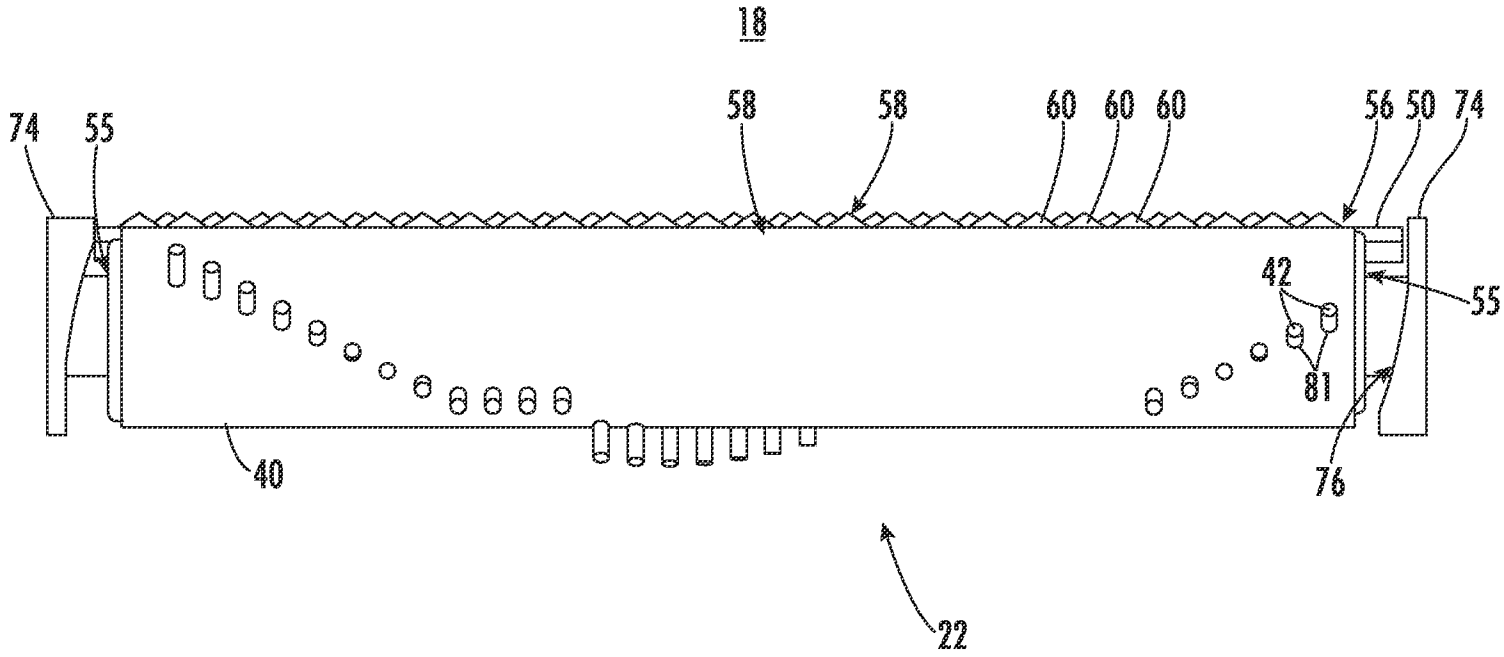
FIG. 3A illustrates a front view of an improved hair cutting brushroll, in accordance with one embodiment of the present disclosure.
Figure 3B:
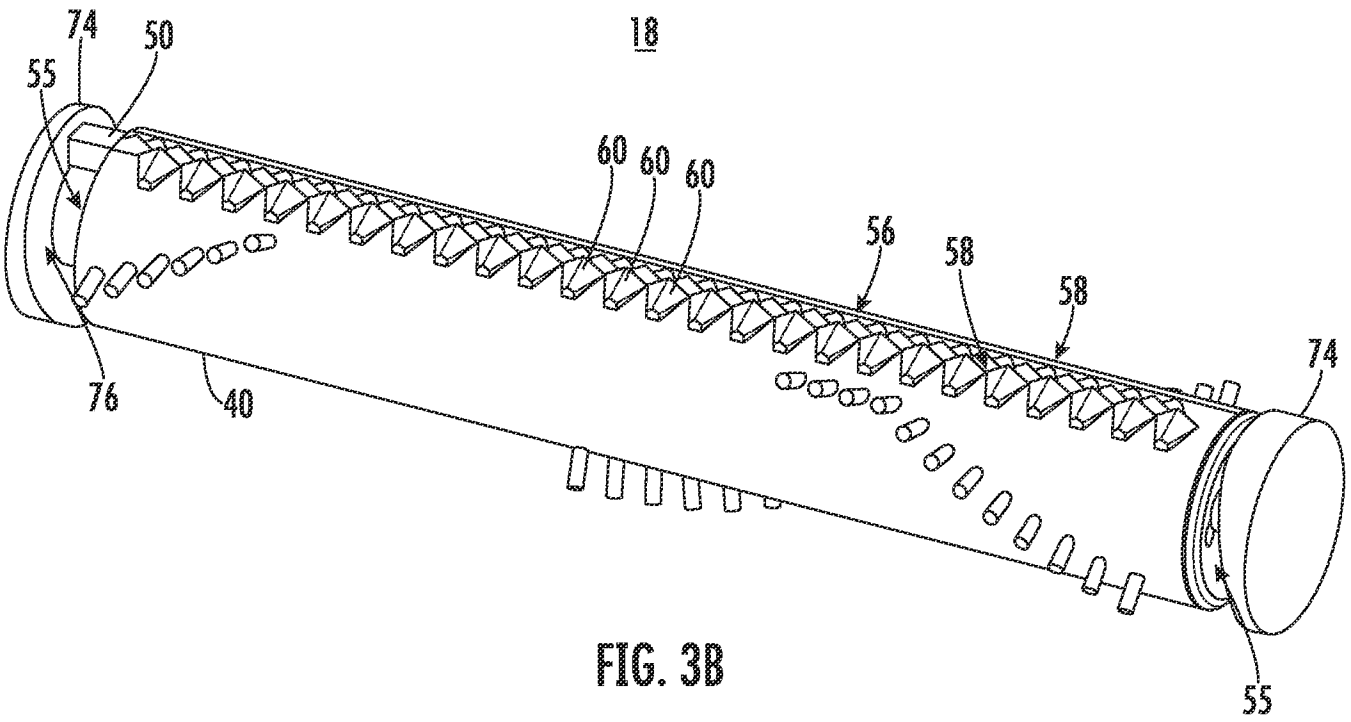
FIG. 3B illustrates a perspective view of the hair cutting brushroll of FIG. 3A.
Figure 3C:
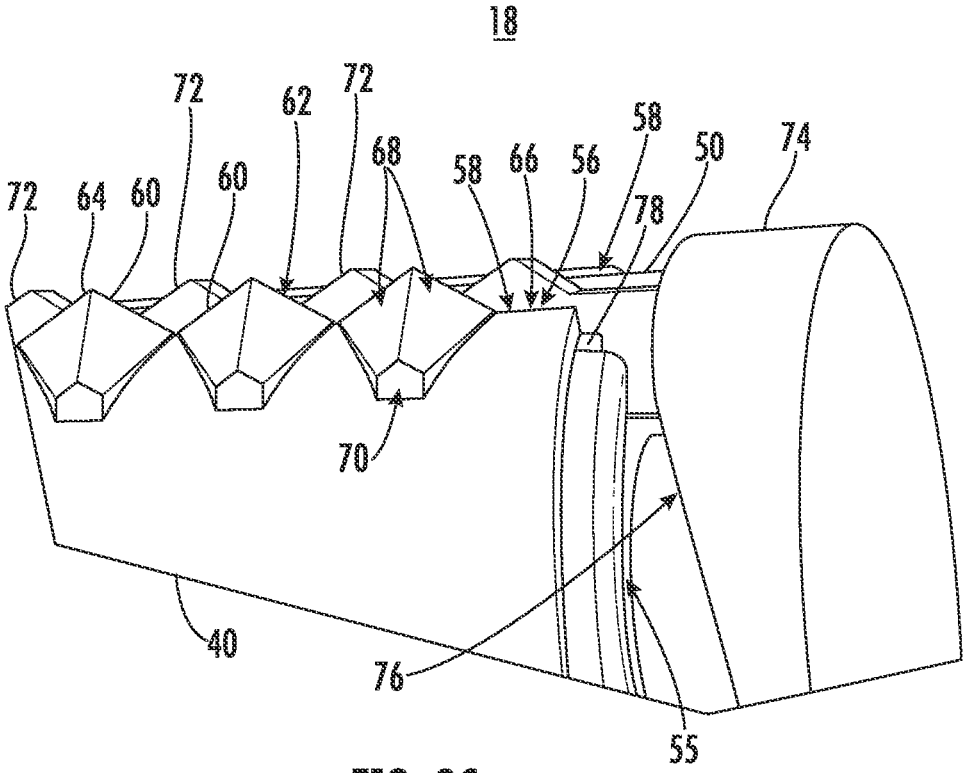
FIG. 3C illustrates a partial end view of the hair cutting brushroll of FIG. 3A.
Figure 4:
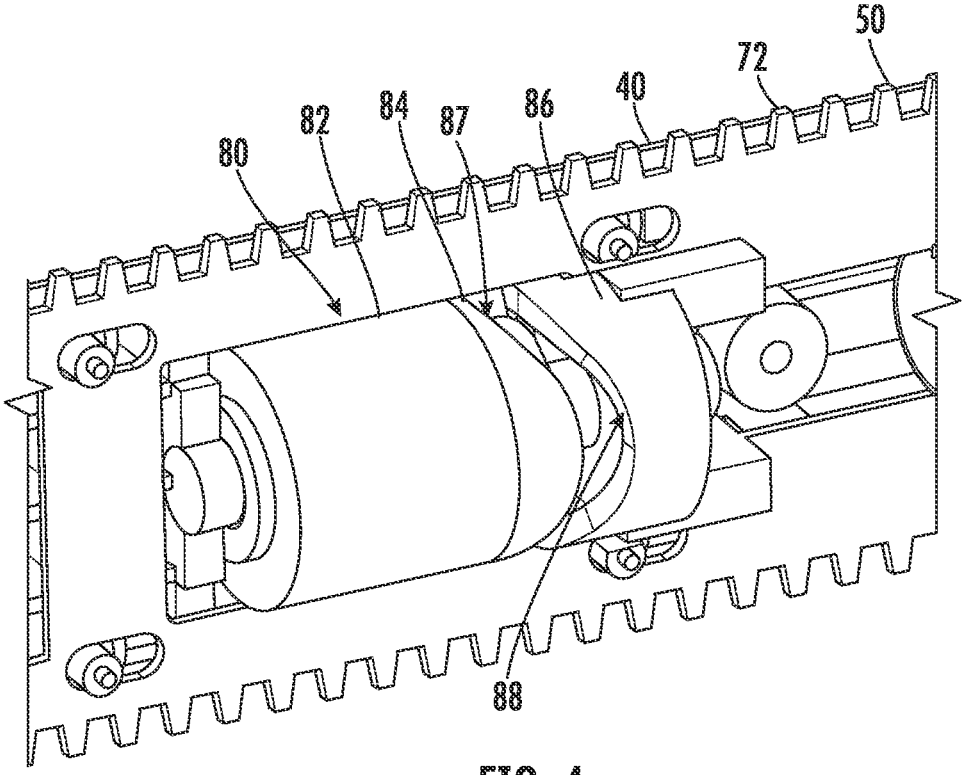
FIG. 4 illustrates a cutaway view of a barrel cam actuator, in accordance with one embodiment of the present disclosure.

Turning now to FIGS. 3-5, various views of one embodiment of an improved hair cutting brushroll 18 is generally illustrated. The hair cutting brushroll 18 may comprise a hollow cylindrical body (e.g., an elongated body) 40 with end openings 55 and one or more slit openings/channels 56 extending between the end openings 55 in an axial/lateral direction relative to the elongated body 40 of the brushroll 18. One or more of the slit openings/channels 56 may extend across all and/or a portion of the elongated body 40 of the brushroll 18. One or more sides 58 of the slit opening 56 may comprise a series of stationary teeth 60 on the outside of the cylinder body 40 proximate to the slit/channel 56. The stationary teeth 60 may be shaped with a flat side 62 (FIG. 3C) proximate to the slit 56 and peak/tip 64 above the exterior/outer surface 66 of the cylinder body 40. The stationary teeth 60 may have two angled surfaces 68 extending away from the flat side 62 that meet at a flat side 70 (best seen in FIG. 3C) distant from the slit 56. The flat side 70 distant from the slit 56 may be raised off the surface 66 of the cylinder body 40 but may be lower than the peak/tip 64 at the flat side 62 proximate to the slit 56. In an embodiment, the stationary teeth 60 may be sized and shaped to self-clean so that the hair cutting brushroll does not seize up when filled with hair.

An axially sliding tooth bar 50 may be received within the slit opening 56 and may be operable to move relative to the cylinder body 40 in an oscillating motion. The sliding tooth bar 50 may comprise a plurality of teeth 72 extending radially and arranged from end to end, wherein the teeth 72 may be sized and shaped to match and/or engage with the size and shape of the teeth 60 on the cylindrical body 40 such that the teeth 72 and/or teeth 60 cut and/or bludgeon hair wrapped around the agitator 18. The sliding tooth bar 50 may be manufactured from either metal or plastic in order to cut hair.

The sliding tooth bar 50 may move back and forth in relation to the cylindrical body 40 via one or more end caps 74 received on the ends of the cylindrical body 40. The end caps 74 may be open barrel cams and may have ramped profiles 76 that are operable to shuttle (e.g., cycle) the sliding tooth bar 50 back and forth within the slit opening 56 of the cylindrical body 40 when the end caps 74 rotate relative to the cylindrical body 40. According to one embodiment, the end caps 74 may be connected to a blade driver 54 that urges (e.g., rotates) the end caps 74 (and thus the cam surfaces 76). The blade driver 54 may cause the end caps 74 to rotate slower than the rotation of the elongated body 40. By way of a non-limiting example, the end caps 74 may be connected to a free spinning flywheel that may lag behind the hair cutting brushroll 18 on start-up and shut-down. The end caps 74 may also be sprung with a wire spring and actuated from a single end of the cylindrical body 40 in an embodiment.

Springs or compressible seals/gaskets 78 (FIG. 3C) may supply closing pressure between the slit opening 56 of the cylindrical body 40 and the sliding tooth bar 50, which keeps hair from folding between the stationary teeth 60 and the sliding tooth bar 50. In operation, the sliding tooth bar 50 moves axially relative to the stationary teeth 60, and the faces of the teeth 72 on the sliding tooth bar 50 are proximate to and/or in contact with the faces of the stationary teeth 60 via oscillating forces.

The cylindrical body 40 may further comprise series of openings 81 (FIG. 3A) in a helix-shaped pattern. The openings 81 may be sized and shaped to receive tufts of bristles 42 through the openings 81 such that when the hair cutting brushroll 18 is rolled in hair, the tufts of bristles 42 may catch the hair and feed the hair into the sliding tooth bar 50 and cut the hair.

In operation, the open barrel cams 74 may axially shuttle the sliding tooth bar 50 once per revolution in one of three types of actuation: synchronous action, reduced action, and periodic action. Synchronous action may be one sliding tooth bar cycle per cam revolution. One advantage of synchronous action may be continuous sheering to protect against hair wrapping around the hair cutting brushroll. Reduced action may be one sliding tooth bar cycle per multiple cam revolutions. And periodic action may be one sliding tooth bar cycle upon some event, such as starting, stopping, speeding up, slowing down, user input such as a button or foot pedal, or some predetermined period of time. One advantage of periodic action may be reduced wear and noise and improved safety.

Intermittent operation may lower noise, vibration, surface wear, and damage from jamming. Intermittent operation may be achieved using an inertial barrel cam. The actuators may be air-powered, which advantageously is failure-resistant, compliant, and does not require contact.

Multiple designs may be used in the hair cutting brushroll, including barrel cams, ramp cams, magnetic actuators, and geared reductors.

Turning now to FIG. 4, a cutaway view of one embodiment of a barrel cam actuator 80 is generally illustrated. The barrel cam actuator 80 may include a weighed mass 82 coupled to a freely spinning cam 84 which may rotate relative to an angularly constrained cam 86, thereby driving a connected sliding tooth bar 50. The freely spinning cam 84 is coupled to and moves with the weighed mass 82. The freely spinning cam 84 and the angularly constrained cam 86 may both have camming surfaces 87, 88 facing each other that are crescent shaped such that when the freely spinning cam 84 rotates about the angularly constrained cam 86, the freely spinning cam 84 moves closer to and further from the angularly constrained cam 86 in an axial direction. This axial movement may cause the actuator to cycle during acceleration events such as start-up, shut-down, and pulsed motor braking, thereby causing the cutting blade 50 to cycle.

Figure 5A:
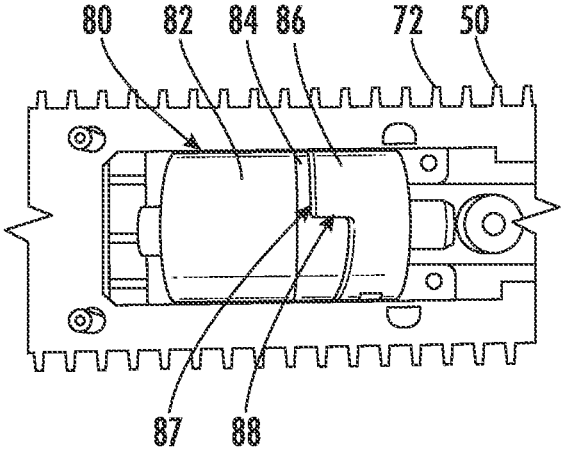
FIG. 5A illustrates an orthogonal view of a single ramp cam in a first position, in accordance with one embodiment of the present disclosure.
Figure 5B:
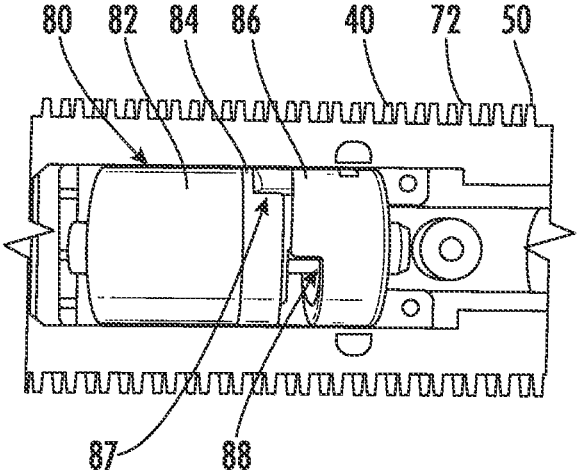
FIG. 5B illustrates an orthogonal view of the single ramp cam of FIG. 5A in a second position, in accordance with one embodiment of the present disclosure.

FIG. 5A illustrates an orthogonal view of a barrel cam actuator 80 including a single ramp cam in a first position, in accordance with one embodiment of the present disclosure. FIG. 5B illustrates the single ramp cam of FIG. 5A in a second, extended position, in accordance with one embodiment of the present disclosure. The single ramp may each have cam surface profiles that start with a raised ramp and end with a stair-step drop down. A single ramp cam may require the least amount of torque to cycle the tooth slides.

Figure 6:
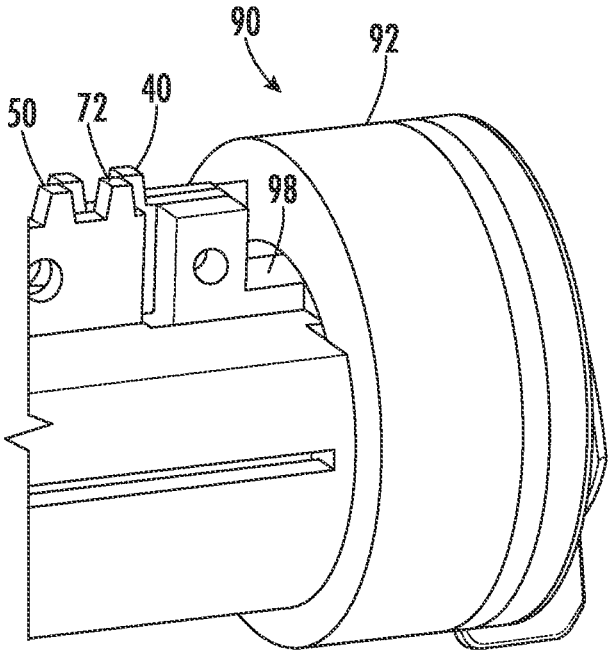
FIG. 6 illustrates a perspective view of a barrel cam, in accordance with one embodiment of the present disclosure.
Figure 7:
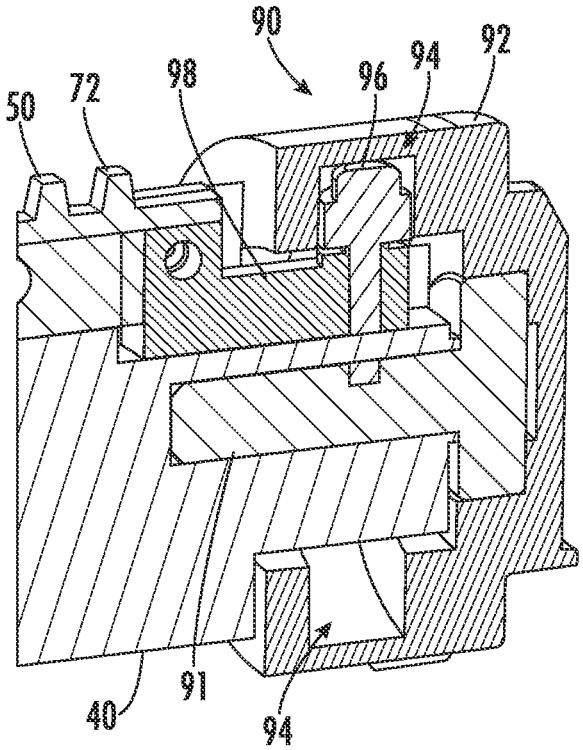
FIG. 7 illustrates a section view of the barrel cam of FIG. 6, in accordance with one embodiment of the present disclosure.
Figure 8:
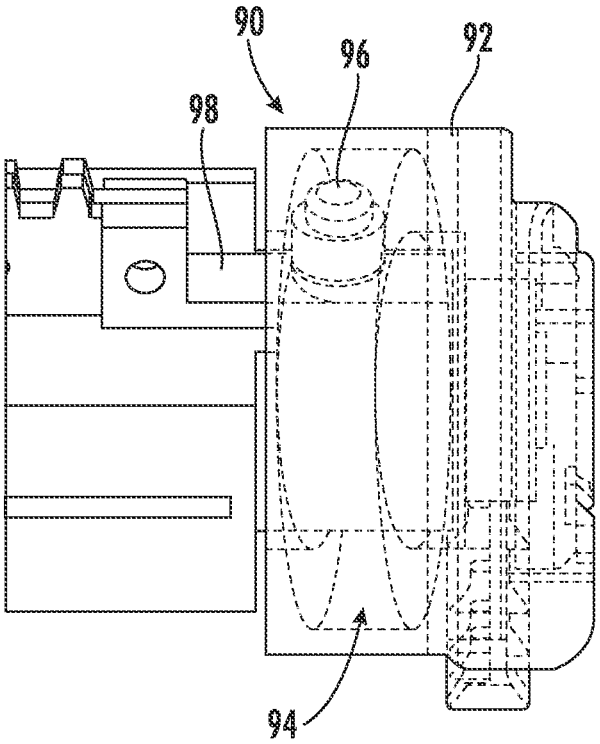
FIG. 8 illustrates a cutaway view of the barrel cam of FIG. 6, in accordance with one embodiment of the present disclosure.

FIG. 6 illustrates a perspective view of a barrel cam 90, in accordance with one embodiment of the present disclosure. FIG. 7 illustrates a section view of the barrel cam 90 of FIG. 6, in accordance with one embodiment of the present disclosure. FIG. 8 illustrates a cutaway view of the barrel cam 90 of FIG. 6, in accordance with one embodiment of the present disclosure. The barrel cam 90 may be referred to as a closed, single side, barrel cam. A stationary end cap 92 houses the cam surface/cam track 94 (FIG. 7) on the inner surface of the end cap 92, which may be a once per revolution track. The elongated body 40 is configured to rotate relative to the stationary end cap 92 (e.g., about a pivot pin/bearing or the like 91). A follower 96 (e.g., a ball bearing follower) may be configured to move within the cam surface/cam track 94 as the brush bar 18 rotates relative to the end cap 92. The follower 96 may move a linkage 98 and the cutting blade 50 axially as the brushroll 18 rotates within the end cap 92. In operation, in a low mode, hair may wrap around the hair cutting brushroll 18 when the barrel cam 90 runs continuously. The one-sided closed barrel cam 90 may be able to produce reciprocations, which may increase noise and motor load.

Figure 9:
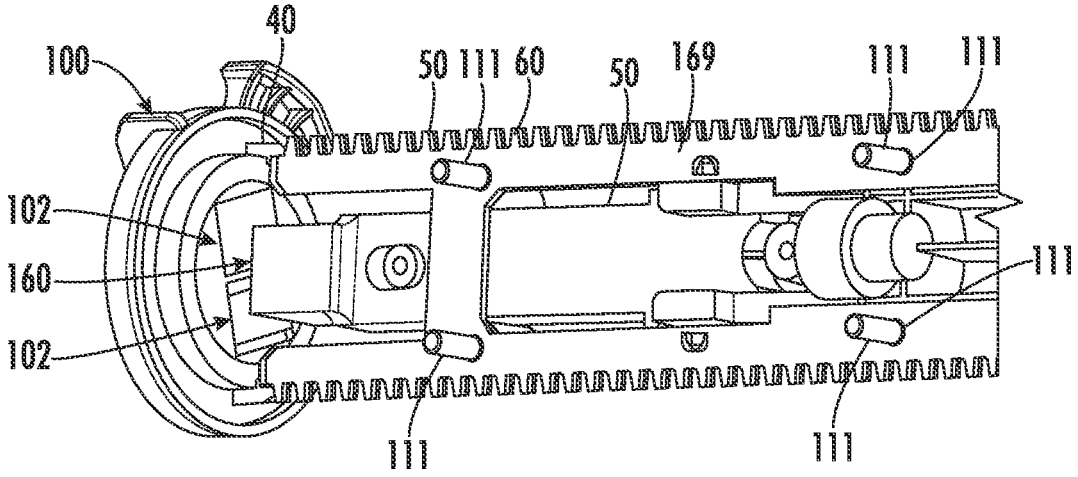
FIG. 9 illustrates a cutaway view of a magnetic actuator, in accordance with one embodiment of the present disclosure.
Figure 10:
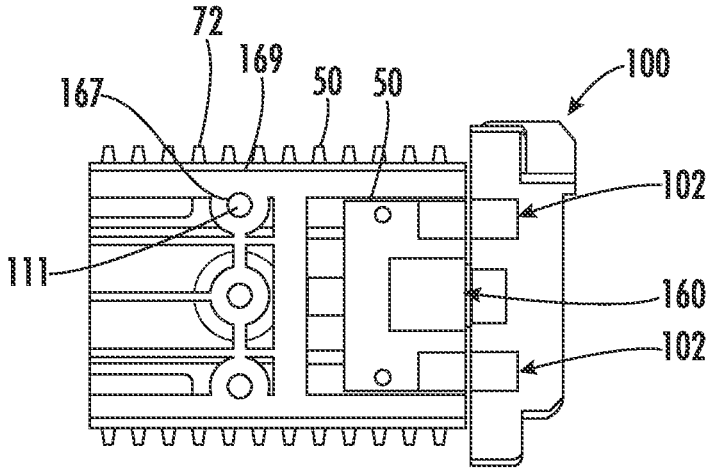
FIG. 10 illustrates a section view of the magnetic actuator of FIG. 9, in accordance with one embodiment of the present disclosure.
Figure 11:
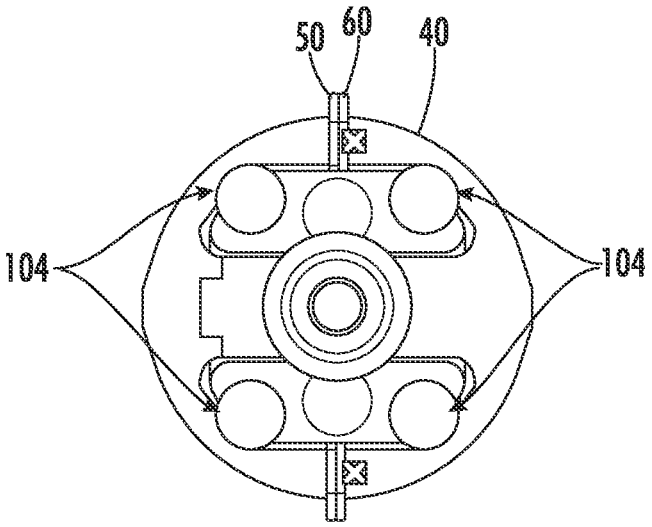
FIG. 11 illustrates an orthogonal end view of the magnetic actuator of FIG. 9, in accordance with one embodiment of the present disclosure.

FIG. 9 illustrates a cutaway view of a magnetic actuator, in accordance with one embodiment of the present disclosure. FIG. 10 illustrates a section view of the magnetic actuator of FIG. 9, in accordance with one embodiment of the present disclosure. FIG. 11 illustrates an orthogonal end view of the magnetic actuator of FIG. 9, in accordance with one embodiment of the present disclosure. The end cap 100 may comprise one or more end cap magnets 102 operable to rotate about the cylindrical body 40 which interact with one or more cutting blade magnets 160 coupled to the cutting blade 50 in order to move the cutting blade 50 axially between the end caps relative to the cylindrical body 40. The poles of the end cap magnets 102 and the cutting blade magnets 160 may be arranged to provide alternating attractive and repulsive magnetic forces which urge the cutting blade 50 back and forth relative to the elongated body 40 as the cutting blade 50 rotates relative to end cap 100. The elongated body portion 40 may include one or more posts 111 (FIG. 9). In the illustrated embodiment, the stationary teeth 50 are formed in a blade base 169 which is separate from the elongated body 40. The posts 111 may retain the blade base 169 (e.g., by being disposed within and/or through holes 167 formed in the blade base 169), though this is optional. The posts 111 may be configured to be received within and/or through one or more slots (e.g., oval apertures, which are behind the blade base 169 and are therefore not visible in FIG. 9) to retain the cutting blade 50 to the elongated body 40, while still allowing the cutting blade 50 to move axially between end caps within the slots. The end cap 100 may further comprise one or more sealing gaskets 104, FIG. 11, operable to prevent debris from entering the cylindrical body 40 at the end caps 100 and to apply blade closure pressure. Magnetic actuators may reduce the frictional losses and mechanical failures that may be experienced by cam-based designs.

Figure 12:
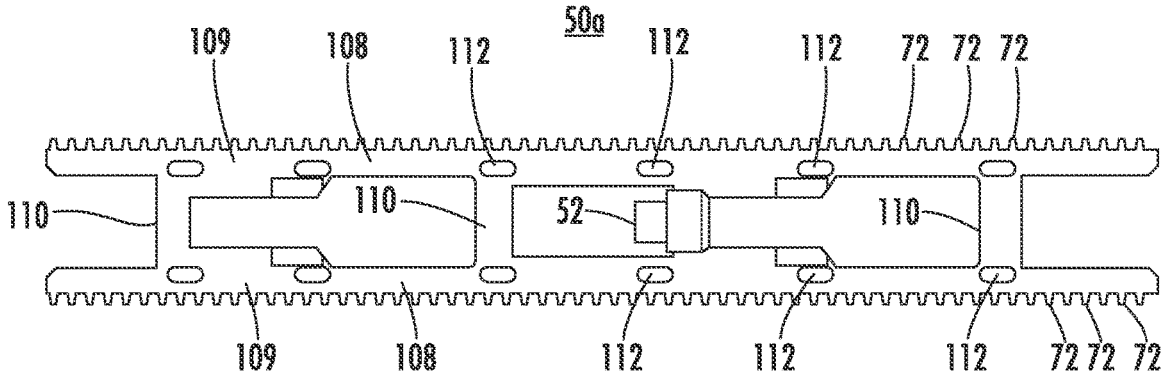
FIG. 12 illustrates an orthogonal view of a blade, in accordance with one embodiment of the present disclosure.

FIG. 12 illustrates an orthogonal view of a two-sided sliding tooth (cutting) bar 50*a*, in accordance with one embodiment of the present disclosure. In an embodiment, the two-sided bar 50*a* may comprise two bars 108 that extend within and/or through two slit openings 46 (not shown in FIG. 12 for clarity) opposite each other in the cylindrical body 40. Each bar 108 may include an elongated body portion 109 having a plurality of teeth 72 extending outward from the elongated body portion 109. The bars 108 may be connected by a body and/or frame (e.g., one or more cross-connectors) 110. The cross-connectors 110 may be integral, unitary, and/or monolithic with the bars 108. The elongated body portion 109 and/or the cross-connectors 110 may comprise one or more slots (e.g., oval apertures) 112 operable to receive posts within the cylindrical body 40 to retain the cutting blade 50*a* to the elongated body 40, while still allowing the cutting blade 50*a* to move axially between end caps within the slots 112. The two-sided cutting blade 50*a* may be configured to be coupled to a cutting blade actuator 52 (a portion of which is illustrated) and ultimately to the cutting blade driver 54 (again, not shown in FIG. 12 for clarity).

Figure 13:
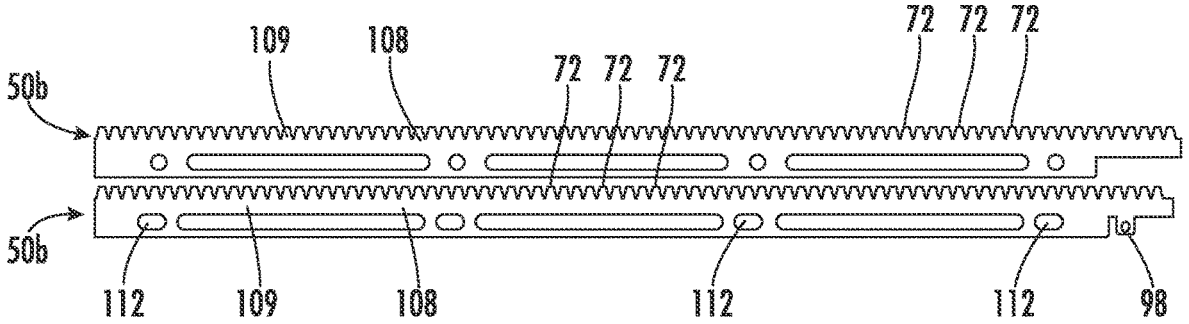
FIG. 13 illustrates an orthogonal view of two blades, in accordance with one embodiment of the present disclosure.

FIG. 13 illustrates an orthogonal view of two blades 50*b*, in accordance with one embodiment of the present disclosure. In an embodiment, two blades 50*b* may be used in place of a two-sided blade (e.g., but not limited to, the two-sided blade 50*a* of FIG. 12). The blades 50*b* may extend within and/or through one or more slit openings 46 (not shown in FIG. 13 for clarity) in the cylindrical body 40. Each blade 50*b* may include a bar 108 having an elongated body portion 109 including a plurality of teeth 72 extending outward from the elongated body portion 109. The blades 50*b* may be coupled (e.g., connected) to each other by one or more separate cross-connectors (not shown for clarity) and may comprise one or more slots operable to receive posts within the cylindrical body. The blades 50*b* may be operable to move axially between end caps at the oval apertures.

One or more of the cutting blades 50*b* may be configured to be coupled to a cutting blade actuator 52 (not shown in FIG. 13 for clarity) and ultimately to the cutting blade driver 54 (again, not shown in FIG. 13 for clarity). In the illustrated embodiment, one of the cutting blades 50*b* includes a linkage 98 for coupling the cutting blade 50*b* to a cutting blade actuator 52 (though this is a non-limiting example of how the cutting blades 50*b* may be coupled to the cutting blade actuator 52). Since both of the cutting blades 50*b* may be coupled to each other, movement of one of the cutting blades 50*b* may also cause the other cutting blade 50*b* to move. It should be appreciated, however, that each cutting blade 50*b* may be separately coupled to one or more cutting blade actuators 52.

In order to mitigate vibration, motor load, and mechanical wear, slowing of the blade cycle rate may be desirable. Three forms of reduction exist: intermittent operation, discussed above; gear train reduction; and auxiliary belts. Intermittent operation cycles blades at a rate that is independent of the brushroll speed. This can be achieved using centrifugal forces, inertial forces, or an actuator external to the brushroll 18. In a centrifugally actuated embodiment, the blades 50 can be in two positions, one above and one below a critical speed, which is the speed above which the weighted elements move to a higher radius. Momentarily crossing the critical speed causes cycling of the blades 50. In an inertial actuated embodiment, the blades 50 are cycled when the speed of the brushroll 18 is changed so as to achieve a critical acceleration, which is the acceleration where the weighted element 82 rotates relative to the brushroll 18. In an externally actuated embodiment, the blades 50 are cycled by a pneumatic or electromechanical actuator, or through user input independent of the rotation of the brushroll 18. Gear train reduction utilizes an internal and/or external gear train to drive the blade actuator 52 at a speed reduced (e.g., significantly reduced) relative to the operation speed (e.g., the speed of the motor rotating the blade actuator 52 and/or the speed of the elongated body 40). An auxiliary belt is a secondary belt that is driven by the same pinion as a brushroll 18, but turns a pulley of a different size (e.g., significantly different size) from the main pulley. These coaxial pulleys result in a low rate relative rotation of the auxiliary shaft which is used to drive the blades 50 with either cam actuators or magnetic actuators.

Figure 14:
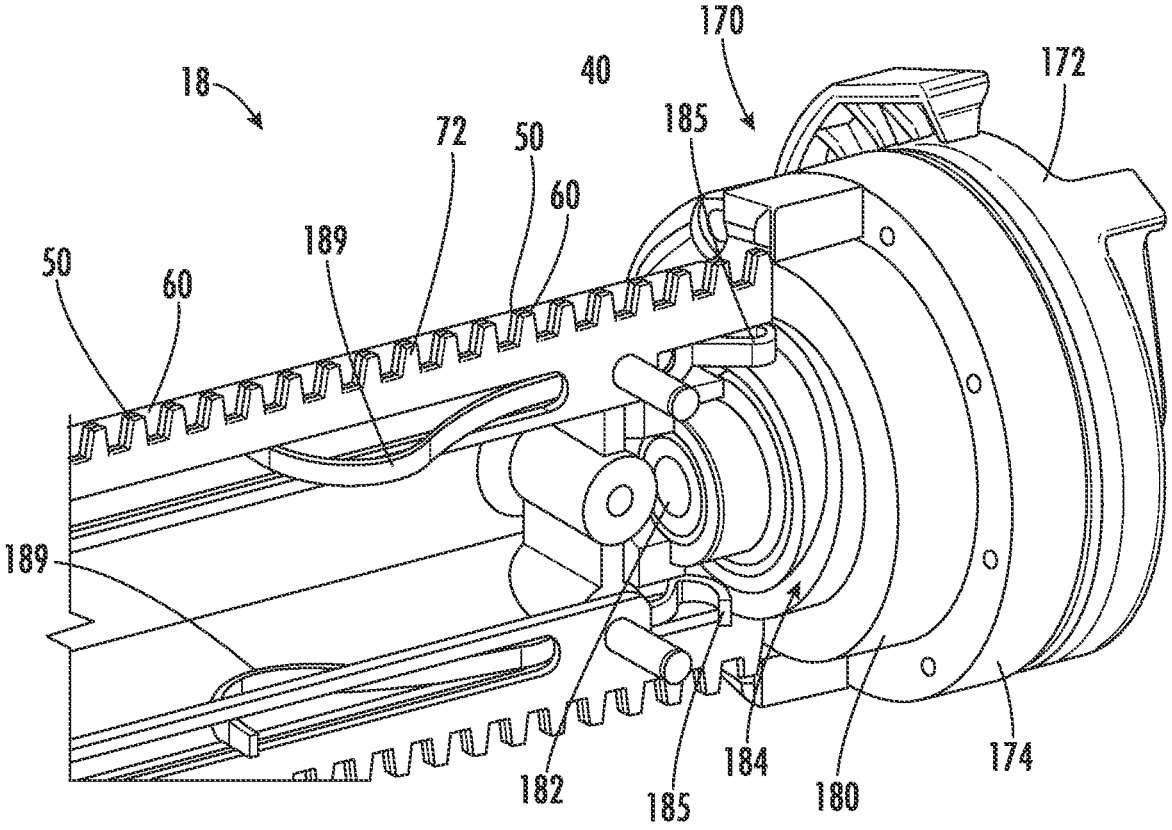
FIG. 14 illustrates a cutaway view of a gear reduction, in accordance with one embodiment of the present disclosure.
Figure 15:
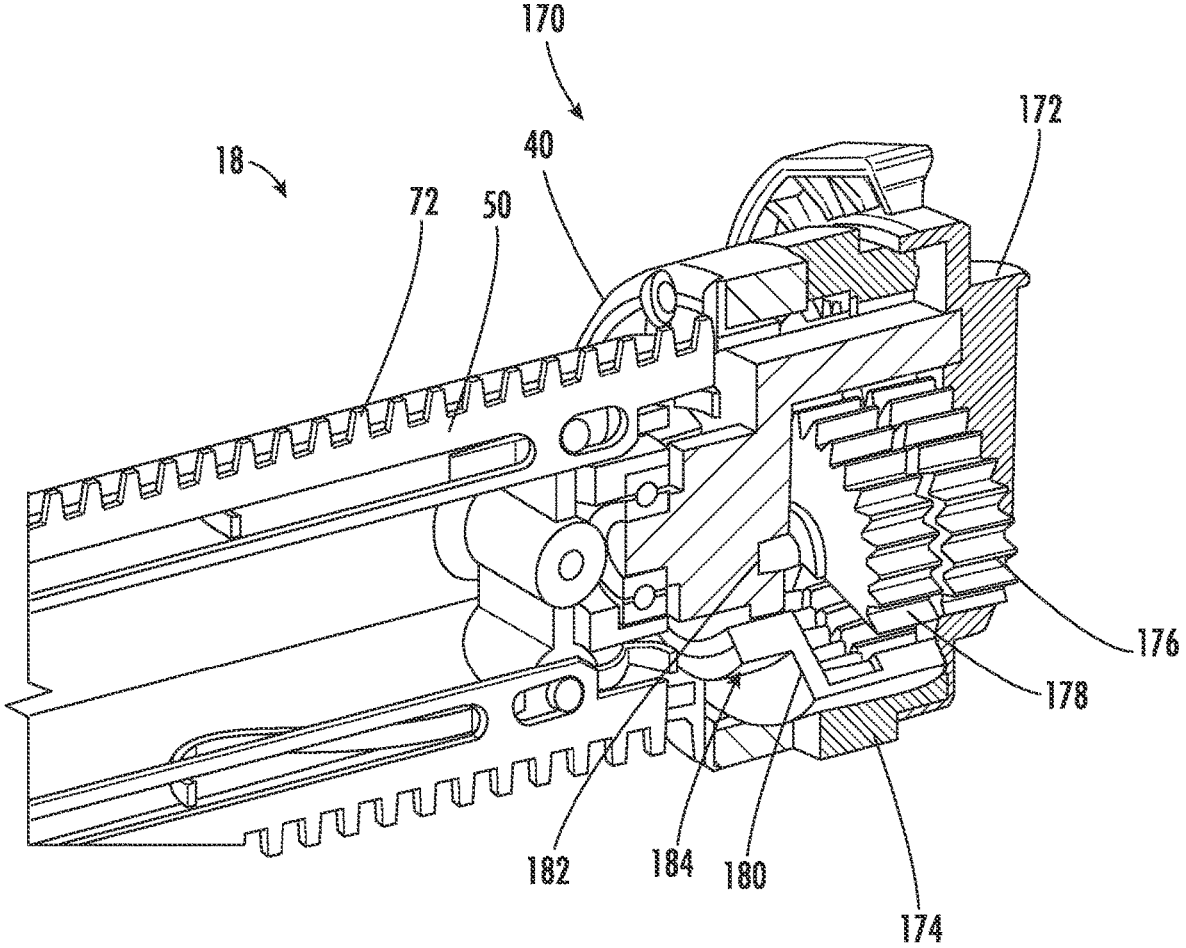
FIG. 15 illustrates a section view of the gear reduction of FIG. 14, in accordance with one embodiment of the present disclosure.
Figure 16:
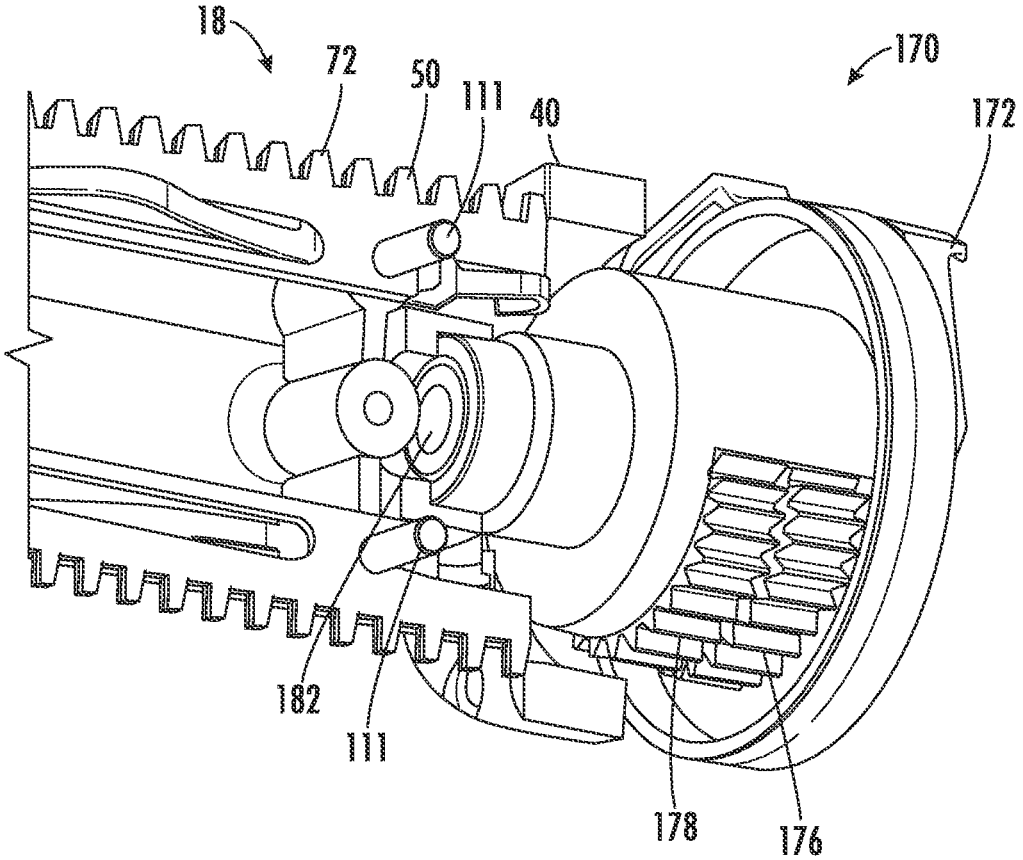
FIG. 16 illustrates a cutaway view of the gear reduction of FIG. 14, in accordance with one embodiment of the present disclosure.
Figure 17:
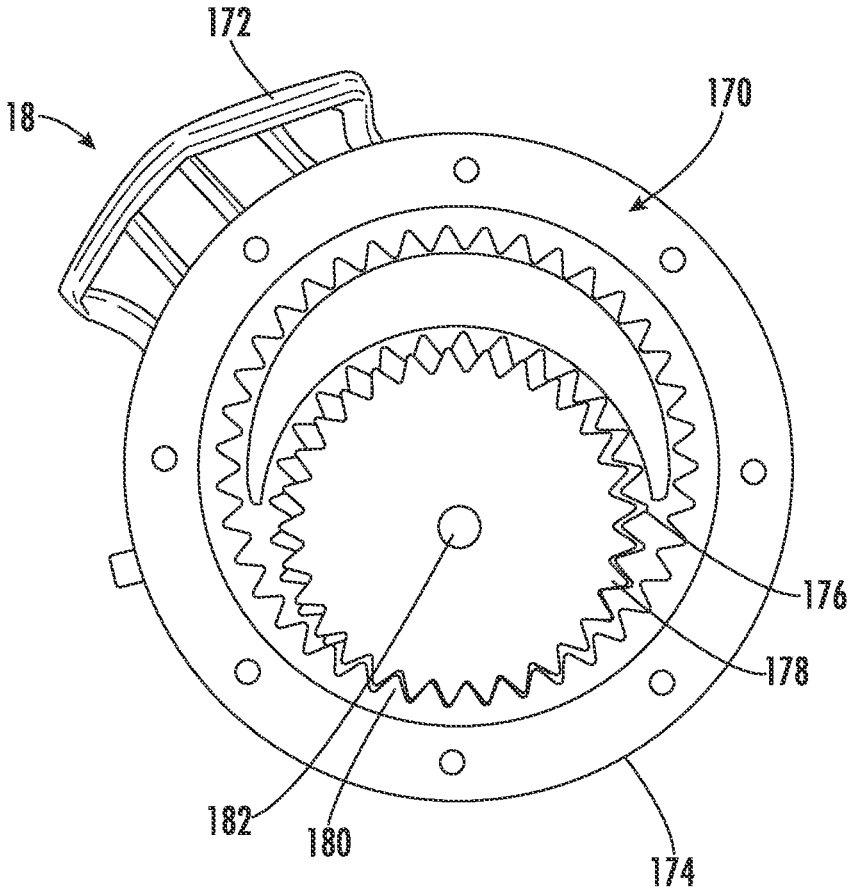
FIG. 17 illustrates an orthogonal view of the gear reduction of FIG. 14, in accordance with one embodiment of the present disclosure.

Turning now to FIGS. 14-17, FIG. 14 illustrates a cutaway view of one embodiment of a gear reduction blade driver 170. FIG. 15 illustrates a section view of the gear reduction 170 of FIG. 14, FIG. 16 illustrates a cutaway view of the gear reduction 170 of FIG. 14, and FIG. 17 illustrates an orthogonal view of the gear reduction 170 of FIG. 14. In an embodiment, a brushroll 18 may one or more stationary end caps 172 (best seen in FIG. 15), at least one driving ring gear 174, at least one first spur gear 176, at least one second spur gear 178, and at least one output ring gear 180. One or more of the end caps 172 may be stationary and do not rotate with the elongated body 40 of the brushroll 18. The end caps 172 may be configured to hold the rotation axis of the spur gears 176, 178. As shown, first and second spur gears 176, 178 are coaxial and rotate about a common idler shaft 182; however, it should be appreciated that the first and second spur gears 176, 178 are not limited to this arrangement and may rotate about different idler shafts 182. The common idler shaft(s) 182 may be offset relative to the axis of rotation of the elongated body 40, the driving ring gear 174, and/or the output ring gear 180 (which may optionally all be coaxial).

The driving ring gear 174 may be part of and/or securely (e.g., rigidly) coupled to the elongated body 40 of the brushroll 18 and turns one or more of the idler shafts 182. The first spur gear 176 is turned by the brushroll 18. In particular, rotation of the brushroll 18 causes the driving ring gear 174 to rotate. The teeth of the driving ring gear 174 engage the teeth of the first spur gear. In the illustrated embodiment, the second spur gear 178 is part of and/or securely (e.g., ridged) coupled to the first spur gear 176, however, this is not a limitation of the present disclosure unless specifically claimed as such. As such, rotation of the driving ring gear 174 may cause rotation of both the first and second spur gears 176, 178. The output ring gear 180 may be coaxial with the elongated body 40 the brushbar 18. Due to the relative number of teeth of the driving ring gear 174, the first spur gear 176, the second spur gear 178, and the output ring gear 180, the rotation of the output ring gear 180 may be reduced (or optionally increased) relative to the elongated body 40 of the brushroll 18. The output ring gear 180 may also include one or more cam surfaces 184 (best seen in FIGS. 14-15) configured to cause one or more cutting blades 50 to cycle between the ends of the elongated body 40.

In the illustrated example, the cutting blade 50 may include one or more cam followers 185 configured to engage (e.g., directly contact) the cam surfaces 184. In one embodiment, the brushroller 18 may include two end caps each including a cam surface 184. One of the end caps may include a gear reduction (e.g., gear reduction 170), while the other end cap may include only a second cam surface 184. Rotation of the elongated body 40 causes one or more of the cam surfaces 184 to rotate, thus causing the cam followers 185 to move linearly back and forth relative to the axis of rotation of the brushroller 18, thereby causing the cutting blade 50 to cycle.

Alternatively (or in addition), only the first end cap 172 of the brushroller 18 may include a gear reduction (e.g., gear reduction 170) and a cam surface 184. In such an embodiment, the second end cap may simply allow the brushroller 18 to rotate about the pivot axis. The brushroller 18 may include one or more return springs 189. In practice, rotation of the brushroller 18 causes the gear reduction 170 and the cam surface 184 to rotate. The cam followers 185, urged by the cam surface 185, causes the cutting blade 50 to move away from the first end cap 172. The return spring 189 may then urge the cutting blade 50 back towards the first end cap 172. The return spring 189 may be integrally from with and/or monolithic with the cutting blade 50 (or alternatively completely separate from the cutting blade 50).

According to one embodiment, one or more of the cam followers 185 and/or the return spring 189 may be formed a leaf spring. In such an embodiment, the leaf spring configuration may allow the cam surface 184 to continue to rotate without causing damage in the event that the blade cutter 50 becomes stuck in place (e.g., if something jams the blade cutter 50 such that the blade cutter 50 cannot cycle, the leaf spring design of the cam followers 185 and/or the return spring 189 may allow the cam surface 184 and the gear reduction 170 to rotate).

By way of a non-limiting example, the gear reduction 170 may include an internal spur ring 174 comprising 40 teeth while the stationary endcap 172 may contain a spur 176 comprising 30 teeth joined to a spur 178 comprising 29 teeth. The cam 184 that pushes the blades 50 may have an internal spur ring 180 comprising 39 teeth, and as a result the cam 184 turns at approximate 0.99 times the speed of the elongated body 40 of the brushroll 18, which is approximately 25 relative rotations per minute. In an embodiment, the brushroll 18 may run with frictional contact instead of geared teeth, as discussed above. The gear sizes may be selected to add so that input 174 and output 180 are coaxial and one or more idler gear pairs 176, 178 are coaxial along one or more separate axis.

Figure 18:
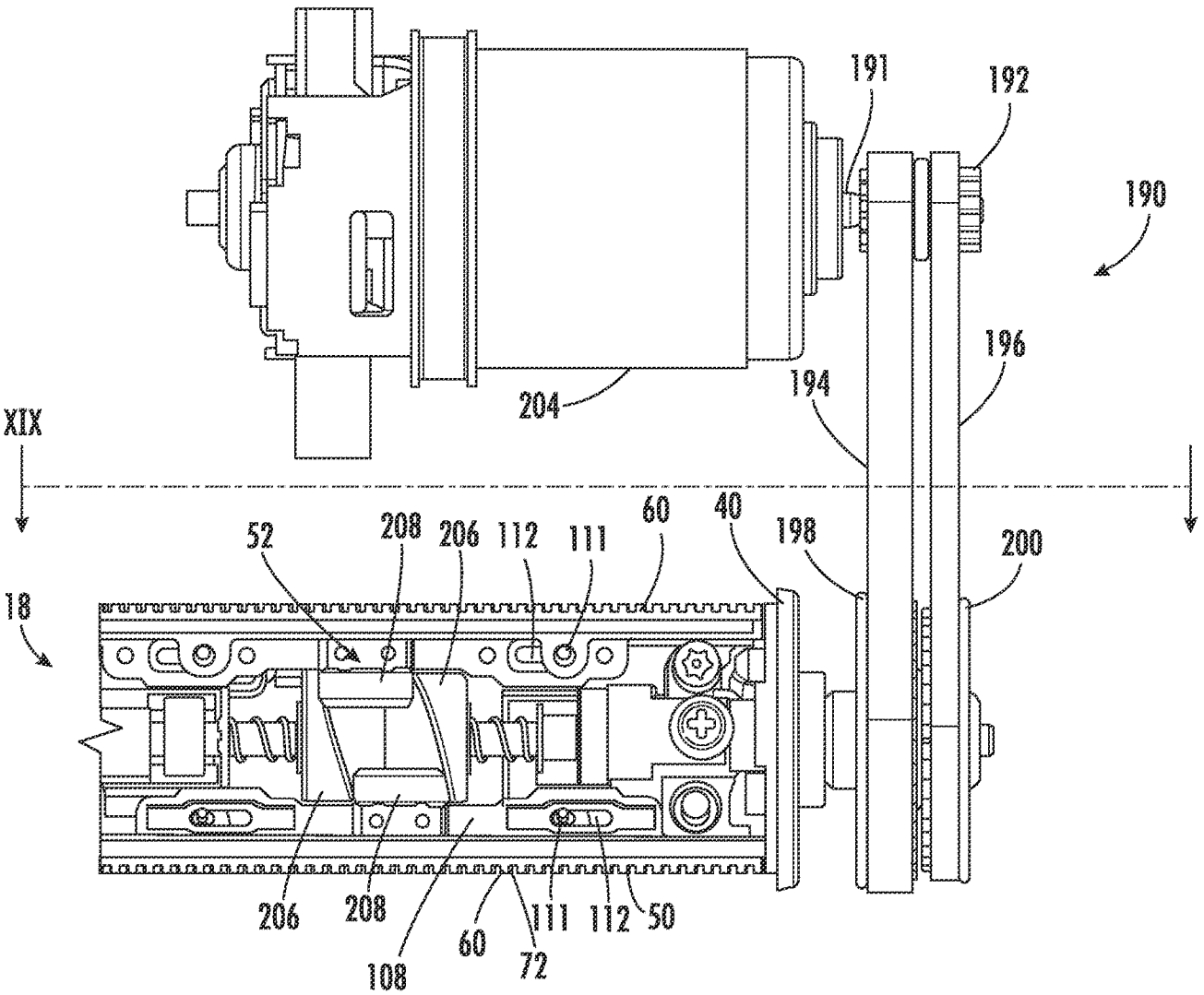
FIG. 18 illustrates a partial cross-sectional view of a belt reducer driver, in accordance with one embodiment of the present disclosure.
Figure 19:
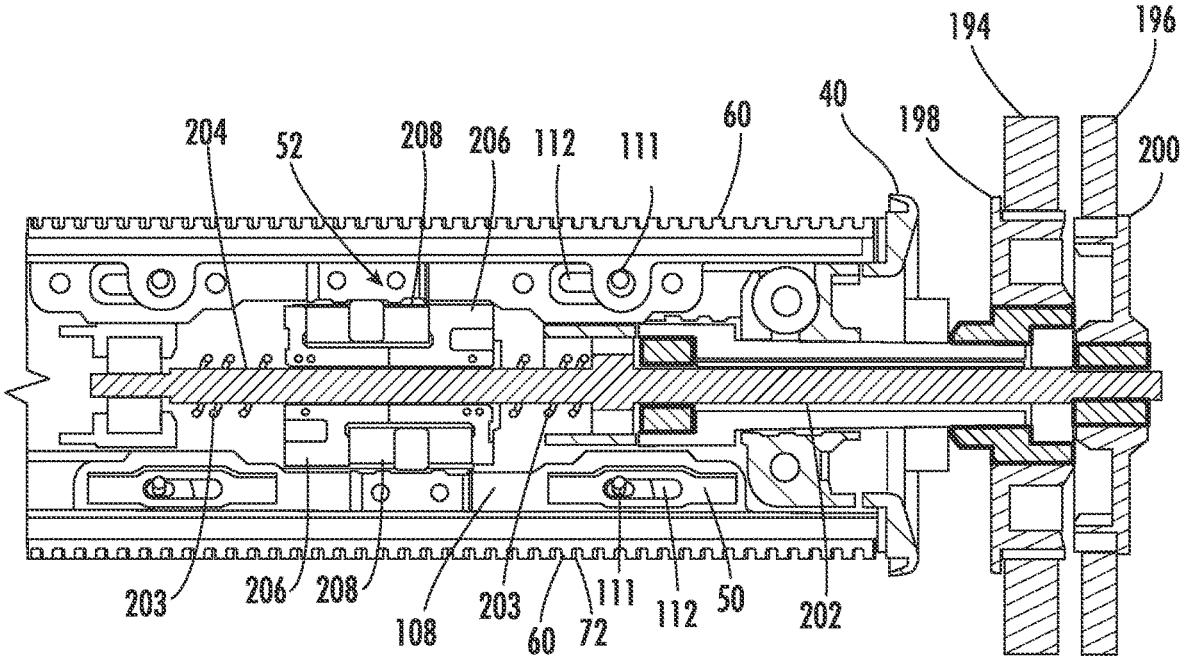
FIG. 19 illustrates a cross-sectional view of the belt reducer driver of FIG. 18 taken along lines XIX-XIX of FIG. 18.
Figure 20:
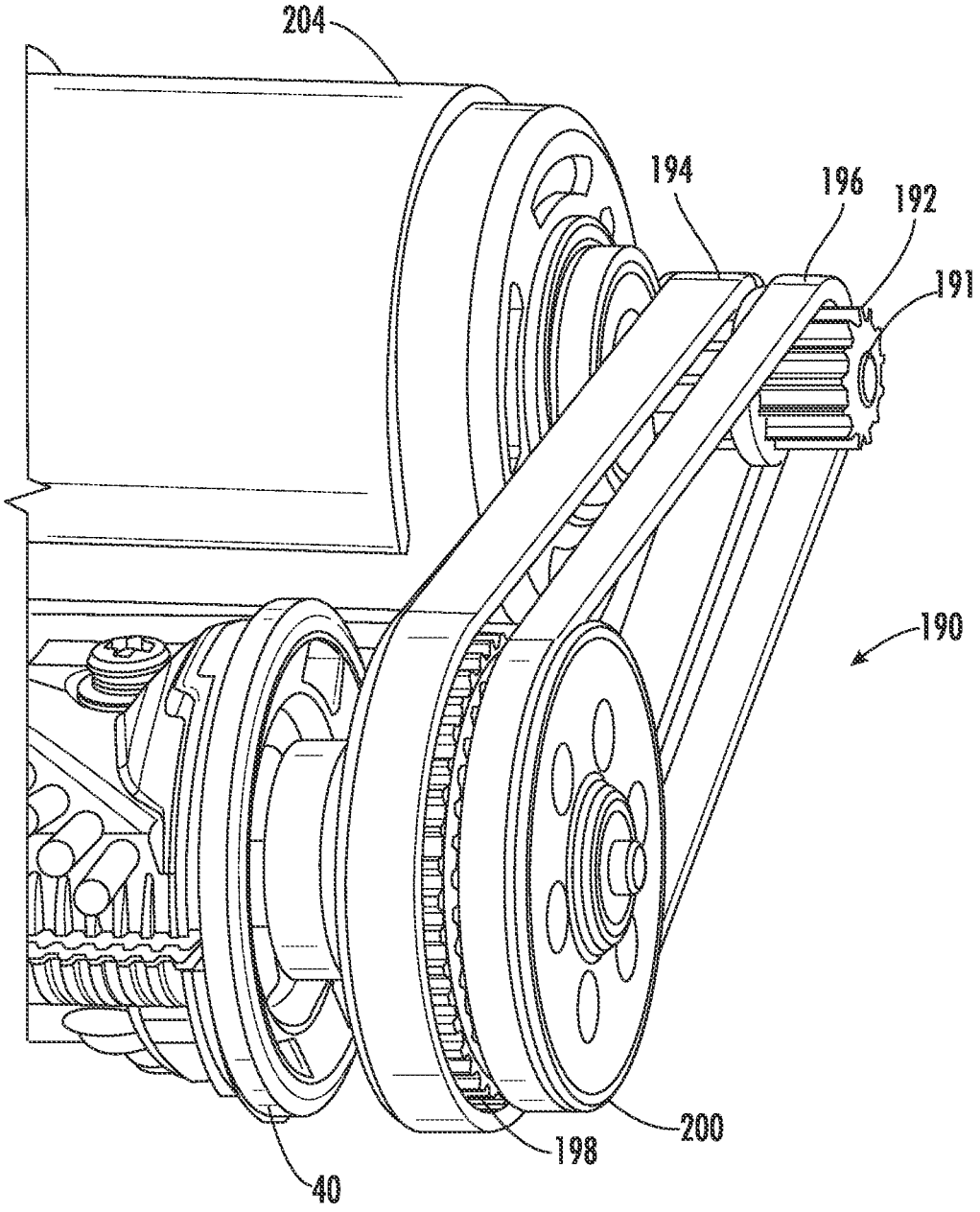
FIG. 20 illustrates a partial end view of the belt reducer driver of FIG. 18.

Turning now to FIGS. 18-20, one embodiment of a belt reducer driver 190 is generally illustrated. The belt reducer driver 190 may comprise one or more pinions 192, a primary (drive) belt 194, a secondary belt 196, a primary pulley 198, a secondary pulley 200, a primary shaft 202, and a secondary shaft 204. As shown, the two-belt reducing driver 190 powers a closed CAM actuator; however, it should be appreciated that the belt reducer driver 190 may be used with any cutting blade actuator 52 (such as, but not limited to, cam actuators and/or magnetic actuators) described herein.

The pinion 192 is coupled to the shaft 191 of the motor 204 (e.g., but not limited to an electric motor) and rotated by the motor 204. Both the primary and secondary belts 194, 196 rotate about the pinion 192. The primary belt 194 transfers power from the motor 204 to the elongated body 40 (via primary shaft 202, FIG. 19) to cause the elongated body 40 of the brushroller 18 to rotate about its pivot axis for agitation. The secondary belt 196 connects the motor 204 to the cutting blade actuator 52 via the secondary shaft 204 (FIG. 19).

By way of a non-limiting example, the cutting blade actuator 52 may include one or more barrel cams 206 (which may include a grooved drum that actuates the teeth 72 of the cutting blade 50) and one or more cam followers 208 (which may include a bearing attached to the moving toothed bar 108 that tracks the groove in the cam 206). Optionally, one or more return springs 203 (FIG. 19) may be provided to urge the cutting blade 40 towards either end of the elongated body 40. By providing the main drive pulley 198 and the secondary pulley 200 with a different diameter (e.g., a different number of teeth), the cycling speed of the blade cutter 50 may be either increased or decreased relative to the rotation rate of the elongated body 40 of the brushroller 18. For example, the secondary pulley 200 may have a larger diameter (e.g., more teeth) than a diameter of the primary pulley 198.

As shown, the belt reducer driver 190 includes a common pinion 192 which engages both the primary and secondary belts 194, 196. While the common pinion 192 may include a belt retainer wall 193, both sides of the common pinion 192 have the same diameter (e.g., same number of teeth) that engage the primary and secondary belts 194, 196. The gear reduction is therefore created by providing the main drive pulley 198 and the secondary pulley 200 with a different diameter (e.g., different number of teeth). Alternatively (or in addition to providing the main drive pulley 198 and the secondary pulley 200 with a different number of teeth), the shaft 191 may be coupled to two different pinions 192 each having a different diameter (e.g., different number of teeth). For example, the diameter of the pinion 192 coupled to the secondary belt 196 (i.e., the secondary pinion) may be smaller than a diameter of the pinion 192 coupled to the primary belt 194 (i.e., the primary pinion).

Figure 21:
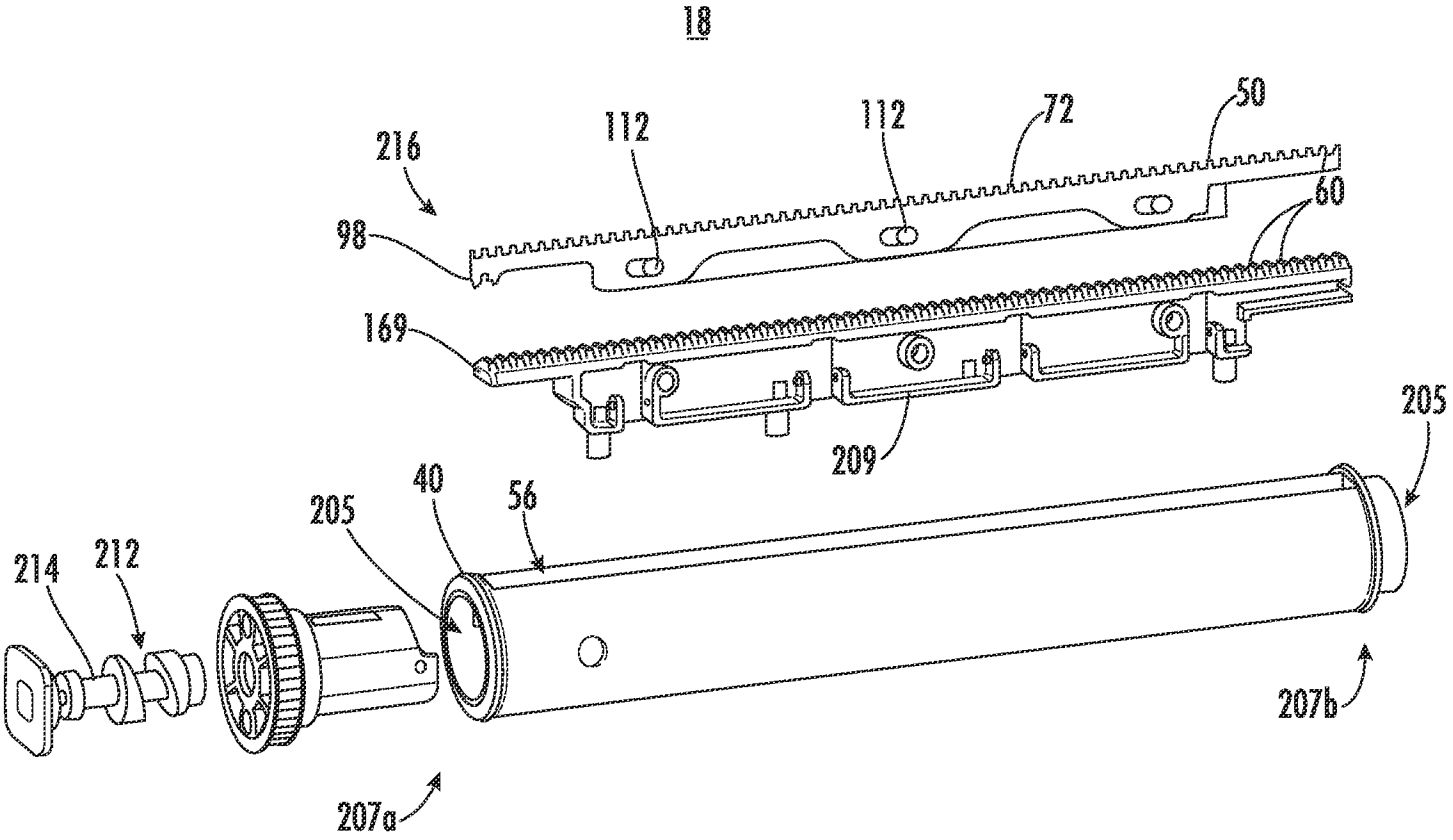
FIG. 21 illustrates an exploded view of an improved hair cutting brushroll, in accordance with one embodiment of the present disclosure.
Figure 22:
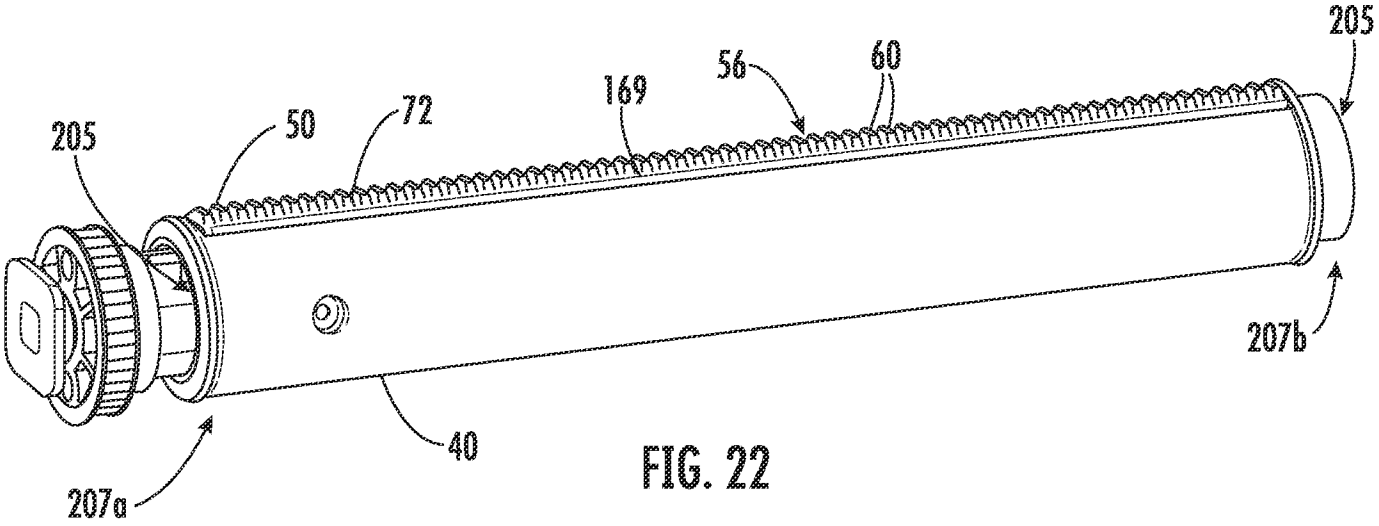
FIG. 22 illustrates an orthogonal view of the brushroll of FIG. 21 in an assembled state, in accordance with one embodiment of the present disclosure.

Turning now to FIGS. 21-22, an exploded view and an assembled view of one embodiment of an improved hair cutting brushroll 18 is generally illustrated. The brushroll 18 may comprise a brush roller body (e.g., an elongated body) 40, which in an embodiment, may be a unibody cylindrical body. The cylindrical body 40 may comprise openings 205 on each end region 207 and a slit opening 56 extending from a first end region 207*a* to a second end region 207*b*. A unibody construction of the elongated body 40 may be stronger and easier to manufacture than a comparable two or more part elongated body construction.

A blade base 169 may be coupled to the elongated body 40. For example, the blade base 169 may be at least partially received in a slot or groove formed in the elongated body 40. The elongated body 40 and/or the blade base 169 may define all or a portion of the slit opening 56. For example, the blade base 169 may define both edges of the slit opening 56 and may be configured to receive the cutting blade 50. Alternatively, the blade base 169 and the elongated body 40 may define opposite edges of the slit opening 56. As such, the blade base 169 may define at least a portion of the slit opening 56.

The blade base 169 may comprise a body 209 and a plurality of stationary teeth 60 extending from the body 209. The plurality of stationary teeth 60 may be arranged in one or more rows (e.g., but not limited to, two rows), facing each other, with a slot 56 between the two rows of teeth 60. With reference to FIG. 3C, the stationary teeth 60 may be shaped with a flat side 62 proximate to the slit 56 and peak 64 above the surface 66 of the cylinder body 40. The stationary teeth 60 may have two angled surfaces 68 extending away from the flat side 62 that meet at a flat side 70 distant from the slit 56. The flat side 70 distant from the slit 56 may be raised off the surface 66 of the cylinder body 40 but may be lower than the peak 64 at the flat side 62 proximate to the slit 56. In an embodiment, the stationary teeth 60 may be sized and shaped to self-clean so that the hair cutting brushroll 18 does not seize up when filled with hair.

The cutting blade 50 may comprise a plurality of teeth 72 that mate with and interact with the plurality of stationary teeth 60 in the rows of the blade base 169. The cutting blade 50 may be received within the slot 56 in the blade base 169 such that the cutting blade 50 may shuttle laterally relative to the blade base 169 to provide a cutting function. The sliding tooth bar 50 may comprise a plurality of teeth 72 extending radially and arranged from end to end, wherein the teeth 72 may be sized and shaped to match the size and shape of the teeth 60 on the cylindrical body 40. The teeth 60, 72 may be sized and shaped to cut hair. The blade teeth 72 may be may be manufactured from either metal or plastic to cut hair. In an embodiment, the blade teeth 72 may be manufactured using a EDM wire cutting process.

The cutting blade 50 may be driven relative to the blade base with a cam 212 and shaft 214 and one or more belt drives (not shown for clarity). In an embodiment, the cam 212 and shaft 214 and the belt drive may be located at one end region (e.g., 207*a*) of the cylindrical body 40 and attached to the cutting blade 50 (e.g., via linkage 98 or the like at one end 216). In an embodiment, a single belt may be used to drive the cam 212 and shaft 214 to shuttle the cutting blade 50 laterally as well as the elongated body 40, or in another embodiment, two different speed belts may be used to drive the cam 212 and shaft 214 in order to shuttle the cutting blade 50 laterally at a different rate than the elongated body 40.

The cam 212 and shaft 214 may axially shuttle the sliding tooth blade 50 once per revolution in one of three types of actuation: synchronous action, reduced action, and periodic action. Synchronous action may be one sliding tooth blade 50 cycle per cam revolution. One advantage of synchronous action may be continuous sheering to protect against hair wrapping around the hair cutting brushroll 18. Reduced action may be one sliding tooth blade cycle per multiple cam revolutions. And periodic action may be one sliding tooth blade cycle upon some event, such as starting, stopping, speeding up, slowing down, user input such as a button or foot pedal, or some predetermined period of time. One advantage of periodic action may be reduced wear and noise and improved safety.

Figure 23:
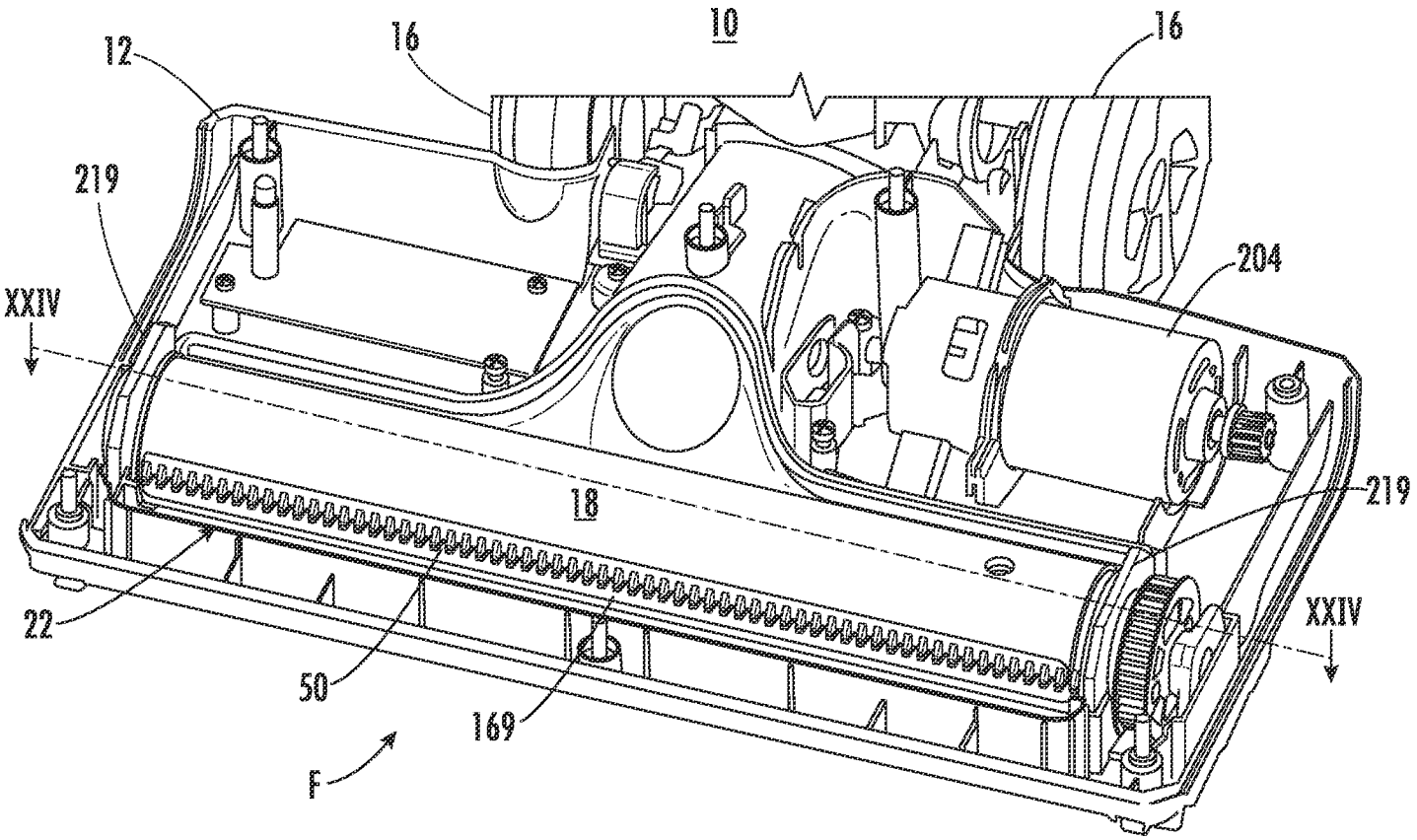
FIG. 23 illustrates a cutaway view of a brushroll inserted into a vacuum nozzle, in accordance with one embodiment of the present disclosure.
Figure 24:
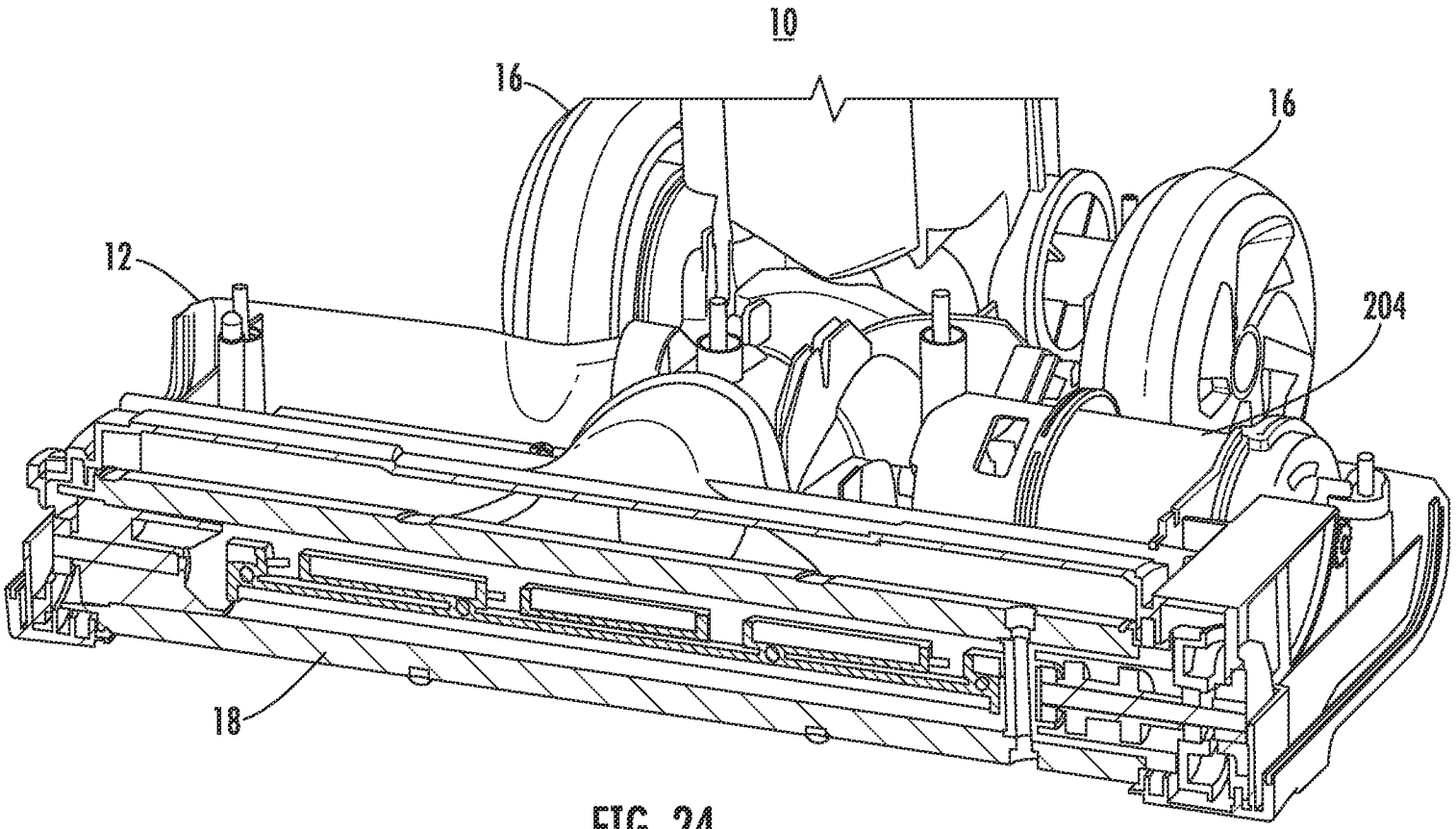
FIG. 24 illustrates a cross-sectional view of the brushroll and vacuum nozzle of FIG. 23 taken along lines XXIV-XXIV of FIG. 23.

FIG. 23 illustrates a perspective view of a brushroll 18 of inserted into one embodiment of a surface cleaning apparatus 10 and FIG. 24 illustrates a cross-sectional view of the surface cleaning apparatus 10 and brushroll 18 of FIG. 23 taken along lines XXIV-XXIV. In the illustrated embodiment, the brushroll 18 is generally consistent with FIGS. 21-22, though it should be appreciated that this is for exemplary purposes only.

As shown in FIGS. 23 and 24, the brushroll 18 may be inserted into and attached to a vacuum nozzle for use in a surface cleaning apparatus 10 (e.g., vacuum cleaner), for example, using one or more retaining caps 219 or the like. The vacuum nozzle may be part of an assembly (e.g., surface cleaning apparatus 10) that rides proximate to the floor and is connected to the vacuum by a swivel. The vacuum nozzle may be designed to control the flow of debris from the floor into the vacuum. The vacuum nozzle may be connected to the rest of the vacuum by the swivel at the rear of the vacuum nozzle. In an embodiment, the brushroll 18 may be oriented within the vacuum nozzle such that the cutting blade 50 and blade base 169 are oriented towards the front F of the vacuum nozzle and the front of the vacuum and extending from side to side of the vacuum nozzle. With this orientation, the brushroll 18 may be used to cut hair sucked into the vacuum nozzle to prevent the hair from clogging the vacuum when it flows from the vacuum nozzle into the vacuum.

Figure 25:
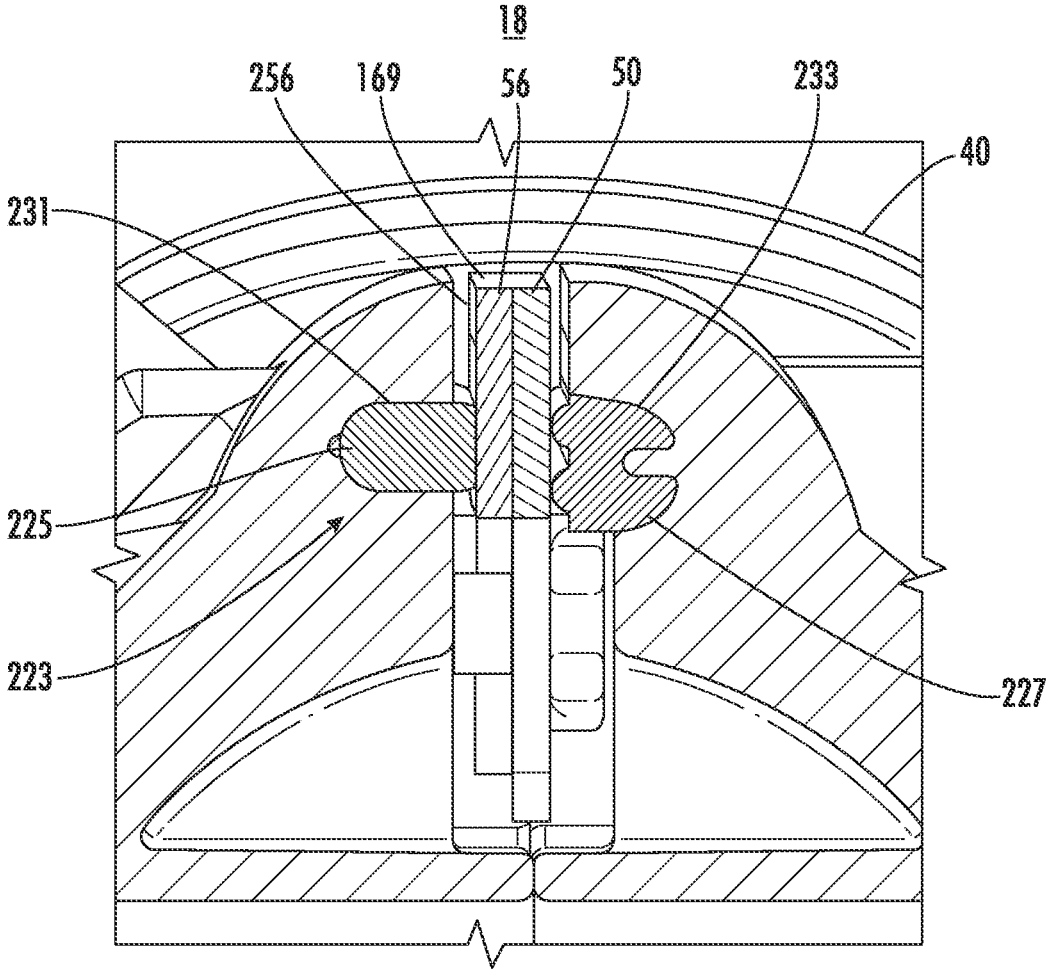
FIG. 25 illustrates a blade closure and sealing system, in accordance with one embodiment of the present disclosure.

Turning now to FIG. 25, one embodiment of a blade closure and sealing system 223 is generally illustrated. In particular, the blade closure and sealing system 223 may include one or more stationary tooth strips 225 and one or more moving cutting blade strips 227. The stationary tooth strips 225 may be provided at least partially within the groove 256 formed in the elongated body 40 of the brushroller 18. The stationary tooth strip 225 may be configured to provide a closure force between the blade base 169 and an interior sidewall of the groove 256 proximate (e.g., adjacent) to the blade base 169. Alternatively (or in addition), the stationary tooth strip 225 may be configured to make a seal between the proximate interior sidewall of the groove 256 and the blade base 169 to generally reduce and/or prevent ingress of debris (e.g., hair) into the groove 256 which could jam the cutting blade 50. The stationary tooth strip 225 may be at least partially disposed within a groove or slot 231 formed in the proximate interior sidewall. According to one embodiment, the stationary tooth strip 225 may be a foam stip. The stationary tooth strip 225 may be formed from a material configured to apply sufficient force against the blade base 169 to provide a closure force between the blade base 169 and the cutting blade 50. For exemplary purposes only, the stationary tooth strip 225 may be formed from a resiliently deformable and/or compressible material such as, but not limited to, rubber, foam (e.g., foam rubber) and/or the like. Alternatively, the stationary tooth strip 225 may be made from spring steel or the like.

The cutting blade strip 227 may be provided at least partially within the slit 56 formed in the elongated body 40 of the brushroller 18. The cutting blade strip 227 may be configured to provide a closure force between the cutting blade 50 and an interior sidewall of the slit 56 proximate (e.g., adjacent) to the cutting blade 50. Alternatively (or in addition), the cutting blade strip 227 may be configured to make a seal between the proximate interior sidewall of the slit 56 and the cutting blade 50 to generally reduce and/or prevent ingress of debris (e.g., hair) into the slit 56 which could jam the cutting blade 50. The cutting blade strip 227 may be at least partially disposed within a groove or slot 233 formed in the proximate interior sidewall. According to one embodiment, the stationary tooth strip 225 may be a low friction and wear plastic capable of making a seal with a moving cutting blade 50 (e.g., made from plastic and/or steel). Since the cutting blade strip 227 contacts the moving cutting blade 50, the cutting blade strip 227 may be formed from wear-resistant a material. The cutting blade strip 227 need only seal the cutting blade 50 to proximate interior sidewall, and does not have to (but may) need to apply a closure force between the blade base 169 and the cutting blade 50. For exemplary purposes only, the cutting blade strip 227 may be formed from a wear resistant material such as, but not limited to, metal (e.g., steel), hard, lubricious plastic, polytetrafluoroethylene (PTFE), and/or polyoxymethylene (POM).

It will be understood that the principal features of this disclosure can be employed in various embodiments without departing from the scope of the disclosure. Those skilled in the art will recognize, or be able to ascertain using no more than routine experimentation, numerous equivalents to the specific procedures described herein. Such equivalents are considered to be within the scope of this disclosure and are covered by the claims.

Additionally, the section headings herein are provided for consistency with the suggestions under 37 CFR § 1.77 or otherwise to provide organizational cues. These headings shall not limit or characterize the invention(s) set out in any claims that may issue from this disclosure. Specifically, and by way of example, although the headings refer to a "Technical," such claims should not be limited by the language under this heading to describe the so-called technical field. Further, a description of technology in the "Background" section is not to be construed as an admission that technology is prior art to any invention(s) in this disclosure. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

The term "or combinations thereof" as used herein refers to all permutations and combinations of the listed items preceding the term. For example, "A, B, C, or combinations thereof is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and/or methods and in the steps or in the sequence of steps of the method described herein without departing from the concept, spirit and scope of the disclosure. All such similar substitutes and modifications apparent to those skilled in the art are deemed to be within the spirit, scope and concept of the disclosure as defined by the appended claims.

What is claimed is:

1. A surface cleaning apparatus comprising:

a cleaning head including a cleaning head body having one or more agitator chambers, the agitator chambers including one or more openings on an underside of the cleaning head body; and a brushroll rotatably mounted to the cleaning head body, the brushroll including:

an elongated body extending laterally between a first end region and a second end region;

a slit opening extending between the first end region and the second end region;

one or more angular stationary teeth extending proximate to at least one edge of the slit opening of the elongated body and between the first and second end regions; and a cutting blade configured to be at least partially received within the slit opening and to cycle laterally between the first and second end regions, wherein the cutting blade bar comprises one or more teeth that are configured to engage with the one or more angular stationary teeth to cut hair;

wherein the cutting blade is configured to continuously cycle while the brushroll rotates in the cleaning head body.

2. The surface cleaning apparatus of claim 1, wherein the brushroll further includes a cutting blade actuator and wherein the surface cleaning apparatus further includes a blade driver, wherein the cutting blade actuator is configured to be coupled to the blade driver for cycling the cutting blade laterally within the slit opening.

3. The surface cleaning apparatus of claim 2, wherein the blade driver is configured to urge the cutting blade actuator and the cutting blade actuator is configured to translate the force imparted by the cutting blade driver into cycling of the cutting blade relative to the slit opening.

4. The surface cleaning apparatus of claim 3, wherein the blade driver is configured to be coupled to an electric motor.

5. The surface cleaning apparatus of claim 4, wherein the blade driver is configured to reduce the cycling rate of the cutting blade relative to the rotation rate of the brushroll.

6. The surface cleaning apparatus of claim 5, wherein the blade driver is also configured to rotate the brushroll.

7. The surface cleaning apparatus of claim 6, wherein the blade driver comprises a reduced belt driver.

8. The surface cleaning apparatus of claim 7, wherein the reduced belt driver comprises:

at least one pinion configured to be rotated by the electric motor;

a primary belt coupled to and rotated by the at least one pinion;

a secondary belt coupled to and rotated by the at least one pinion;

a primary pulley coupled to and rotated by the primary belt;

a secondary pulley coupled to and rotated by the secondary belt;

a primary shaft coupled to and rotated by the primary pulley, wherein rotation of the primary shaft causes rotation of the elongated body; and a secondary shaft coupled to and rotated by the secondary pulley, wherein rotation of the secondary shaft causes cycling of the cutting blade within the slit opening;

wherein rotation of the at least one pinion causes the secondary shaft to rotate slower than the primary shaft.

9. The surface cleaning apparatus of claim 8, wherein the at least one pinion includes a common pinion configured to be coupled to both the primary belt and the secondary belt, and wherein a diameter of the secondary is larger than a diameter of the primary pulley.

10. The surface cleaning apparatus of claim 8, wherein the at least one pinion includes a primary pinion coupled to the primary belt and a secondary pinion coupled to the secondary belt, wherein a diameter of the primary pinion is larger than a diameter of the secondary pinion.

11. The surface cleaning apparatus of claim 7, wherein the cutting blade actuator comprises a closed barrel actuator.

12. The surface cleaning apparatus of claim 11, wherein the closed barrel actuator comprises:

a stationary end cap including an internal cam track;

a follower configured to move within the internal cam track as the brushbar rotates relative to the stationary end cap; and linkage coupled to the follower and the cutting blade such that movement of the follower as the brushbar rotates within the end cap causes cycling of the cutting blade within the slit opening.

13. The surface cleaning apparatus of claim 7, wherein the cutting blade actuator comprises an open barrel actuator.

14. The surface cleaning apparatus of claim 5, wherein the blade driver comprises a gear reduction blade driver.

15. The surface cleaning apparatus of claim 14, wherein the gear reduction blade driver comprises:

a stationary end cap;

a driving ring gear coupled to the elongated body of the brushroll such that the driving ring gear rotates at the same speed as the elongated body of the brushroll;

a first spur gear having teeth that engage teeth of the driving ring gear;

a second spur gear coupled to the first spur gear such that the first and second spur gears rotate at the same speed; and an output ring gear having teeth that engage teeth of the second spur gear;

wherein rotation of the output ring gear causes the cutting blade to cycle within the slit opening.

16. The surface cleaning apparatus of claim 15, wherein the first and second spur gears have a pivot axes which are concentric, the driving ring gear and the output ring gear have pivot axes which are concentric, and wherein the pivot axes of the first and second spur gears are offset relative to the pivot axes of the driving ring gear and the output ring gear.

17. The surface cleaning apparatus of claim 3, further comprising a cam follower coupling the cutting blade to the cutting blade actuator, wherein the cam follower includes a leaf spring configured to allow the cutting blade actuator to continue to rotate when the cutting blade stops rotating within the slit opening.

18. The surface cleaning apparatus of claim 1, wherein the cutting blade is configured to synchronously cycle with the rotation of the brushroll.

19. The surface cleaning apparatus of claim 1, further comprising a blade base configured to be at least partially received in and coupled to a groove formed in the elongated body, the blade base defining at least a portion of the slit opening and including at least some of the stationary teeth.

20. The surface cleaning apparatus of claim 19 further comprising:

a one or more stationary tooth strips configured to provide a closure force between the blade base and the groove formed in the elongated body and prevent ingress of debris into the groove; and one or more moving cutting blade strips configured to prevent ingress of debris into the slit opening.

* * * * *